US006045276A

United States Patent [19]

Matsuhashi et al.

[11] Patent Number: 6,045,276

[45] **Date of Patent: *Apr. 4, 2000**

[54] TAPE CARTRIDGES

[75] Inventors: Kunihiko Matsuhashi; Hideo Sodeyama; Daisuke Inakoshi, all of Suwa, Japan

[73] Assignees: Seiko Epson Corporation; King Jim Co., Ltd., both of Tokyo, Japan

[ * ] Notice: This patent is subject to a terminal disclaimer.

[21] Appl. No.: 08/909,084

[22] Filed: Aug. 14, 1997

Related U.S. Application Data

[63] Continuation of application No. 08/513,139, Aug. 9, 1995, Pat. No. 5,702,192.

[30] Foreign Application Priority Data

Sep. 8, 1994 [JP] Japan ..... 6-209172

[51] Int. Cl.[7] ..... B41J 11/53

[52] U.S. Cl. ..... 400/613; 400/615.2; 400/661.1; 400/662

[58] Field of Search ..... 400/613, 615.2, 400/661.1, 662, 648

[56] References Cited

U.S. PATENT DOCUMENTS

| | | | |
|---|---|---|---|
| 4,728,967 | 3/1988 | Tomita et al. . | |
| 5,503,482 | 4/1996 | Kawakami et al. | 400/615.2 |
| 5,702,192 | 12/1997 | Matshashi et al. | 400/613 |

FOREIGN PATENT DOCUMENTS

| | | |
|---|---|---|
| 0535840 A1 | 4/1993 | European Pat. Off. . |
| 0593269 A2 | 4/1994 | European Pat. Off. . |
| 0598418 A3 | 5/1994 | European Pat. Off. . |
| 0600593 A2 | 6/1994 | European Pat. Off. . |

OTHER PUBLICATIONS

Patent Abstracts of Japan; vol. 10, No. 114 (M–473) [2171] Apr. 26, 1986.

Patent Abstracts of Japan; vol. 9, No. 316 (M–438) [2039 ]Dec. 12, 1985.

Patent Abstracts of Japan; vol. 18, No. 413 (M–1649), Aug. 3, 1994.

Patent Abstracts of Japan; vol. 12, No. 55 (M–669) [2902] Feb. 19, 1988.

*Primary Examiner*—John Hilten
*Attorney, Agent, or Firm*—Loeb & Loeb LLP

[57] ABSTRACT

When different tape cartridges accommodating printing tapes having different hardness, thicknesses or widths are exchangeably mounted in the same printing apparatus, excellent printing can be obtained using the present embodiment. In a platen 12 provided in a tape cartridge 10, the harder, thicker or wider the tape T accommodated in the tape cartridge 10, the softer a platen rubber provided on a surface of the platen. The platen rubber 14 having a hardness corresponding to the properties of the tape T is used so as to obtain an ideal contact state between a printing head and the tape T regardless of the properties of the tape T when the tape cartridge 10 is mounted in a tape writer 1. Accordingly, the tape T can be properly conveyed by the platen 12 and a tape guide pin 26 regardless of its properties, and can be brought into contact with a printing head through an ink ribbon R in an ideal and consistent contact state. As a result, the printing head performs a printing operation under optimum conditions and high quality printing can be obtained.

8 Claims, 22 Drawing Sheets

TAPE CARTRIDGES

This is a continuation of U.S. patent application Ser. No. 08/513,139, filed Aug. 9, 1995, now U.S. Pat. No. 5,702,192, entitled TAPE CARTRIDGES, naming as inventor(s) Kunihiko MATSUHASHI, Hideo SODEYAMA, Daisuke INAKOSHI.

BACKGROUND OF THE INVENTION

1. Field of the Invention

The present invention relates to tape cartridges, and more particularly to tape cartridges which can be mounted in and removed from a printing apparatus having a printing head, printing tape and a platen for nipping the printing tape in cooperation with the printing head in such a manner that printing can be produced thereon when the tape cartridge is mounted on the printing apparatus.

2. Description of the Related Art

Devices for printing a desired string of characters on the front surface of an adhesive tape with an adhesive coating on the rear surface thereof have been previously known. Such a printing apparatus enables the user to readily print, for example, a headline or a title on the surface of a tape, with the printed tape being easily adhered to the spine or cover of a document file or to the spine of a video tape. Such a printing apparatus is very useful and is extensively used in industrial fields and households.

Various attempts have been made to realize the desired goals of reduced size and weight in such printers. One method for achieving these objectives is an improvement in a printing section of the printing apparatus which typically requires a large space for installation. A printing apparatus has therefore been proposed, with the apparatus having a structure in which a platen for enabling printing on a tape in cooperation with a printing head is provided in a tape cartridge. During printing, the printing head nips a printing tape in cooperation with the platen. The above-described structure enables the tape cartridge to be readily replaced by retracting the printing head and replacing the cartridge.

Printing tapes typically differ in material, width and color and different types of ink ribbons may be used to print on the tapes. Tape cartridges which can accommodate various types of printing tapes are commercially available. For a given application, the user selects a tape cartridge which can accommodate the type of tape suited to the application from among various types of tape cartridges, and mounts it on the printing apparatus.

However, the ability of such tape cartridges to accommodate different types of tapes may lead to a significant decline in print quality depending on the particular combination of printing apparatus and type of printing tape. Specifically, a desired contact state between the printing head and the tape cannot be obtained when a tape cartridge which accommodates, for example, a thick tape is mounted in a printing apparatus originally designed to employ a thin tape or conversely when a tape cartridge which accommodates a thin tape is mounted in a printing apparatus originally designed to employ a thick tape. If the desired contact state between the printing head and the tape is not achieved, the print quality is adversely affected. One solution to the problem of poor contact between the printing head and the tape is to provide in the printing apparatus a mechanism for adjusting the position of the printing head in accordance with the thickness of the tape. However, the use of this method makes the entire structure of the apparatus more complicated. A further problem with this method is that for a given tape cartridge, the user must check whether the adjusting mechanism of the printing apparatus is in a state corresponding to the thickness of the tape accommodated in the mounted tape cartridge. If the mechanism is not set to accommodate the appropriate tape thickness, the user must operate the adjusting mechanism, making the use of such a printing apparatus troublesome. The above-described problems occur not only with respect to the thickness of the tape accommodated in the tape cartridge but also with respect to the width and hardness of the tape as well as the width of the ink ribbon.

Certain combinations of platens and ink ribbons may also lead to ink smears on the printing tape. When the tape cartridge is mounted in the printing apparatus, the tape and the ink ribbon are pressed against the platen by the printing head. If the width of the tape and ink ribbon is larger than the width of the printing head and if the platen is made of a relatively soft material, the pressure of the printing head will significantly deform the platen, and the tape and ink ribbon will be firmly pressed against the edges and end portions of the printing head. In such a situation, the ink may be undesirably transferred to the printing tape.

SUMMARY OF THE INVENTION

An objective of the present invention is to provide a set of tape cartridges which will eliminate the above-described problems and ensure quality printing regardless of the type of tape and ink ribbon.

The present invention provides in a first aspect thereof a set of tape cartridges including at least two types of tape cartridges each of which can be mounted in and removed from a printing apparatus having a printing head and which accommodate printing tapes having at least two different types of hardness. Each of the tape cartridges includes:

a printing tape having a certain hardness selected from at least two different hardness; and a platen for nipping the printing tape in cooperation with the printing head in such a manner that printing can be conducted on the printing tape when the tape cartridge is mounted in the printing apparatus.

The platen has rubber disposed on a surface thereof. In the set of tape cartridges, the harder the printing tape, the softer the rubber on the surface of the platen.

The present invention provides in a second aspect thereof a set of tape cartridges including at least two types of tape cartridges each of which can be mounted in and removed from a printing apparatus having a printing head, and which accommodate printing tapes having at least two different widths. Each of the tape cartridges includes:

a printing tape having a certain width selected from at least two different widths; and a platen for nipping the printing tape in cooperation with the printing head in such a manner that printing can be conducted on the printing tape when the tape cartridge is mounted in the printing apparatus.

The platen has rubber disposed on a surface thereof. In the set of tape cartridges, the wider the printing tape, the softer the platen rubber.

The present invention provides in a third aspect thereof a kit having a set of tape cartridges including at least two types of tape cartridges each of which can be mounted in and removed from a printing apparatus having a printing head, and which accommodate printing tapes having at least two different thicknesses. Each of the tape cartridges includes:

a printing tape having a certain thickness selected from at least two different thicknesses; and a platen for nipping the printing tape in cooperation with the printing head in such a manner that printing can be conducted on the printing tape when the tape cartridge is mounted in the printing apparatus.

The platen has rubber disposed on a surface thereof. In the set of tape cartridges, the thicker the printing tape, the softer the platen rubber.

The present invention provides in a fourth aspect thereof a set of tape cartridges including at least two types of tape cartridges each of which can be mounted in and removed from a printing apparatus having a printing head, with the set accommodating printing tapes having at least two different combinations of hardness, thickness and width. Each of the tape cartridges includes:

a printing tape having a certain combination of hardness, thickness and width selected from at least two different combinations of these characteristics; and a platen for nipping the printing tape in cooperation with the printing head in such a manner that printing can be conducted on the printing tape when the tape cartridge is mounted in the printing apparatus.

The platen includes a shaft and a platen rubber fitted on the shaft. In the set of tape cartridges, the harder, thicker or wider the printing tape, the smaller an outer diameter of the shaft and the thicker the platen rubber.

The present invention provides in a fifth aspect thereof a set of tape cartridges including at least two types of tape cartridges each of which can be mounted in and removed from a printing apparatus having a printing head, and which accommodate printing tapes having at least two different types of properties. Each of the tape cartridges includes:

a printing tape having the one special type of property selected from at least two different types of properties; and a platen for nipping the printing tape in cooperation with the printing head in such a manner that printing can be conducted on the printing tape when the tape cartridge is mounted in the printing apparatus.

The platen has rubber disposed on a surface thereof. A surface of the rubber which contacts the printing tape has a roughness corresponding to a material and a roughness of a surface of the printing tape which contacts the platen.

The present invention provides in a sixth aspect thereof a tape cartridge which can be mounted in and removed from a printing apparatus having a printing head. The tape cartridge accommodates therein:

a printing tape;

an ink ribbon for transferring ink to the printing tape; and a platen for nipping the printing tape in cooperation with the printing head in such a manner that printing can be conducted on the printing tape when the tape cartridge is mounted in the printing apparatus.

The printing head includes a printing section and a substrate on which the printing section is mounted.

The printing tape and the ink ribbon are wider than the substrate.

The platen is wider than the substrate, and has rubber disposed on a surface thereof. The rubber has a hardness which ensures that deformation of the platen rubber caused by the pressure of the printing head will not exceed a predetermined value.

The present invention provides in a seventh aspect thereof a tape cartridge which can be mounted in and removed from a printing apparatus having a printing head. The tape cartridge accommodates therein:

a printing tape;

an ink ribbon for transferring ink to the printing tape; and a platen for nipping the printing tape and the ink ribbon in cooperation with the printing head in such a manner that printing can be conducted thereon when the tape cartridge is mounted in the printing apparatus.

The printing head includes a printing section and a substrate on which the printing section is mounted.

The ink ribbon is wider than the printing portion and narrower than the substrate.

The present invention provides in an eighth aspect thereof a tape cartridge which can be mounted in and removed from a printing apparatus having a printing head. The tape cartridge accommodates therein:

a printing tape; and a platen for nipping the printing tape in cooperation with the printing head in such a manner that printing can be conducted thereon when the tape cartridge is mounted in the printing apparatus.

The printing head includes a printing section and a substrate on which the printing section is mounted.

The platen is wider than the printing section and narrower than the substrate.

The present invention provides in a ninth aspect thereof a set of tape cartridges including at least two types of tape cartridges which can be mounted in and removed from a printing apparatus having a printing head. The tape cartridge accommodates therein:

a printing tape;

an ink ribbon to be used for printing on the printing tape;

a tension generation means for creating tension in a longitudinal direction along the ink ribbon; and a platen for nipping the printing tape in cooperation with the printing head in such a manner that printing can be conducted on the printing tape when the tape cartridge is mounted in the printing apparatus.

In the set of tape cartridges, the wider the ink ribbon, the more tension the tension generation means generates.

The ink ribbon is incorporated into the cartridge in such a manner that the tension generated by the tension generation means moves the printing head away from the platen.

The wider the ink ribbon, the smaller outer diameter of the platen.

In the tape cartridge provided according to the ninth aspect of the present invention, the wider the ink ribbon, the softer the platen.

In the tape cartridge provided according to aspects one through nine of the present invention, the platen has a barrel shape with a central portion having an outer diameter larger than the outer diameter of the end portions thereof.

In the set of tape cartridges provided according to the first aspect of the present invention, the harder the printing tape, the softer the rubber provided on the surface of the platen. This ensures that optimum uniform conditions are maintained when the printing head presses the printing tape against the platen regardless of the hardness of the printing tape. As a result, high quality printing can be obtained regardless of the hardness of the printing tape.

In the set of tape cartridges provided according to the second aspect of the present invention, the wider the printing tape, the softer the rubber provided on the surface of the platen. This ensures that optimum uniform conditions are maintained when the printing head presses the printing tape against the platen regardless of the width of the printing tape. As a result, high quality printing can be obtained regardless of the width of the printing tape.

In the set of tape cartridges provided according to the third aspect of the present invention, the thicker the printing tape, the softer the rubber provided on the surface of the platen. This ensures that optimum uniform conditions are maintained when the printing head presses the printing tape against the platen regardless of the width of the printing tape. As a result, high quality printing can be obtained regardless of the thickness of the printing tape.

In the set of tape cartridges provided according to the fourth aspect of the present invention, the outer diameter of the platen shaft decreases as the hardness, thickness or width of the printing tape increases. Conversely, the thickness of the platen rubber increases as the hardness, thickness or width of the printing tape increases. This ensures that optimum uniform conditions are maintained when the printing head presses the printing tape against the platen regardless of the hardness, thickness and width of the printing tape. As a result, high quality printing can be obtained regardless of the hardness, thickness and width of the printing tape.

In the set of tape cartridges provided according to the fifth aspect of the present invention, the surface of the platen rubber which makes contact with the printing tape has a roughness corresponding to the roughness of the contacting surface of the printing tape. As a result, high quality printing can be obtained regardless of the roughness of the contact surface of the printing tape.

In the tape cartridge provided according to the sixth aspect of the present invention, the platen is wider than the substrate of the printing head. The rubber disposed on the surface of the platen has a hardness which ensures that deformation of the rubber caused by the pressure of the printing head will not exceed a predetermined value. Therefore the smearing of the printing tape, which is caused when the printing tape and the ink ribbon are firmly pressed against the substrate of the printing head, can be prevented.

In the tape cartridge provided according to the seventh aspect of the present invention, the ink ribbon is wider than the printing portion and narrower than the substrate. Therefore the smearing of the printing tape, which is caused when the printing tape and the ink ribbon are firmly pressed against the substrate of the printing head, can be prevented.

In the tape cartridge provided according to the eighth aspect of the present invention, the platen is wider than the printing portion and narrower than the substrate of the printing head. Therefore the smearing of the printing tape, which is caused when the printing tape and the ink ribbon are firmly pressed against the substrate of the printing head, can be prevented.

In the set of tape cartridges provided according to the ninth aspect of the present invention, as the width of the ink ribbon increases, the longitudinal tension created by the tension generation means increases. Since the tension generated by the tension generation means acts so as to move the printing head away from the platen, the pressing force of the printing head against the platen is reduced. As this pressing force decreases and the width of the ink ribbon increases, the outer diameter of the platen decreases. As a result, the positional relationship between the printing head and the platen remains constant regardless of the width of the printing tape and high quality printing can be obtained despite the variation in width of the printing tape.

In the tape cartridge provided according to the ninth aspect of the present invention, when a platen whose hardness decreases as the width of the ink ribbon increases is employed, even if the pressing force of the printing head varies according to the width of the ink ribbon, the hardness of the platen will correspond to the resulting pressing force of the printing head. Accordingly, the positional relationship between the platen and the printing head remains the same, and consequently, excellent printing can be obtained.

In the tape cartridge provided according to aspects one through nine of the present invention, the platen has a barrel shape whose central portion has an outer diameter which is larger than the outer diameter of either of the two end portions thereof. Therefore the tape is conveyed at a rate which is consistent across its entire width. Accordingly, the shifting of the printing tape or ink ribbon toward one end of the platen and twisting of the printing tape or ink ribbon can be eliminated, and consequently excellent printing can be obtained.

The present invention generally provides in a tenth aspect thereof a kit of tape cartridges including at least two different types of tape cartridges. Each tape cartridge included in the kit is fitted with a platen which is specifically adapted to achieve ideal printing conditions when used with a particular combination of printing tape and ink ribbon. The printing tape accommodated by a particular cartridge in the kit has a particular hardness, thickness, width and color which distinguishes it from other tapes. The ink ribbon which is incorporated in a particular tape cartridge has a particular width and color which distinguishes it from other types of ink ribbons.

With the kit provided according to the tenth aspect of the present invention, a single printing apparatus may be used to perform printing operations on several different types of printing tapes. These printing operations can be performed without making any adjustment or modification to either the printing apparatus or the tape cartridges used in the printing operations. To perform printing on a different type of printing tape, the user simply removes the currently mounted tape cartridge using the appropriate dismounting procedure and mounts a new cartridge which employs the desired type of printing tape.

The present invention provides in an eleventh aspect thereof a method of manufacture for a kit including a set of tape cartridges. Each individual cartridge in the kit is fitted with a platen shaft with a platen rubber disposed thereon, with the platen being individually adapted so as to provide ideal printing conditions when used with a printing tape having a particular hardness, thickness and width for a given cartridge in the kit.

DESCRIPTION OF THE PREFERRED EMBODIMENTS

To further clarify the structure and function of the above-described present invention, a tape cartridge, which is a preferred embodiment of the present invention, and a tape writer or printer for detachably incorporating the tape cartridge to conduct printing on the tape will now be described.

Figure 1:
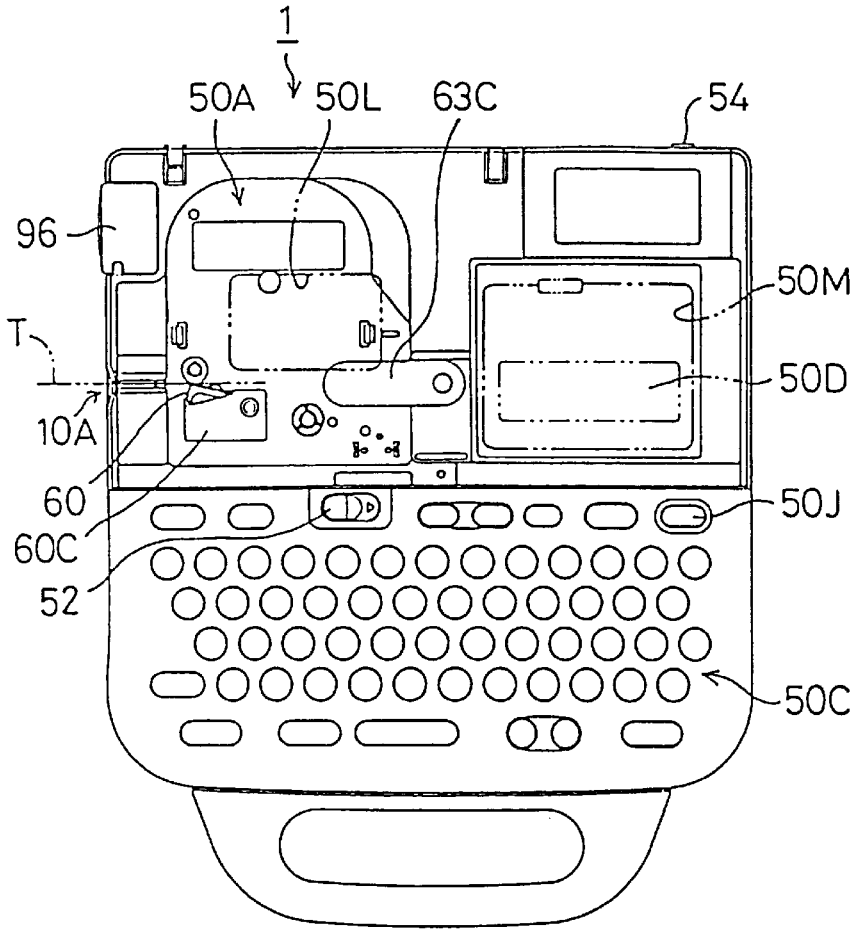
FIG. 1 is a plan view of a tape writer 1 in which tape cartridges according to the present invention can be mounted.
Figure 2:
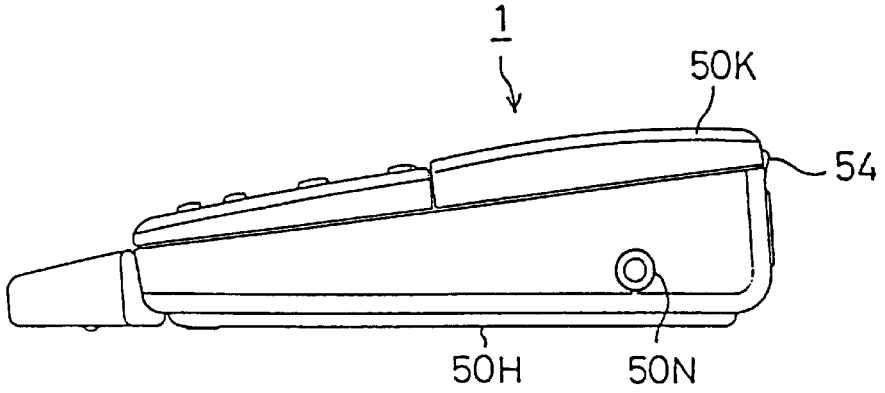
FIG. 2 is a side elevational view of the tape writer 1 of FIG. 1.
Figure 3:
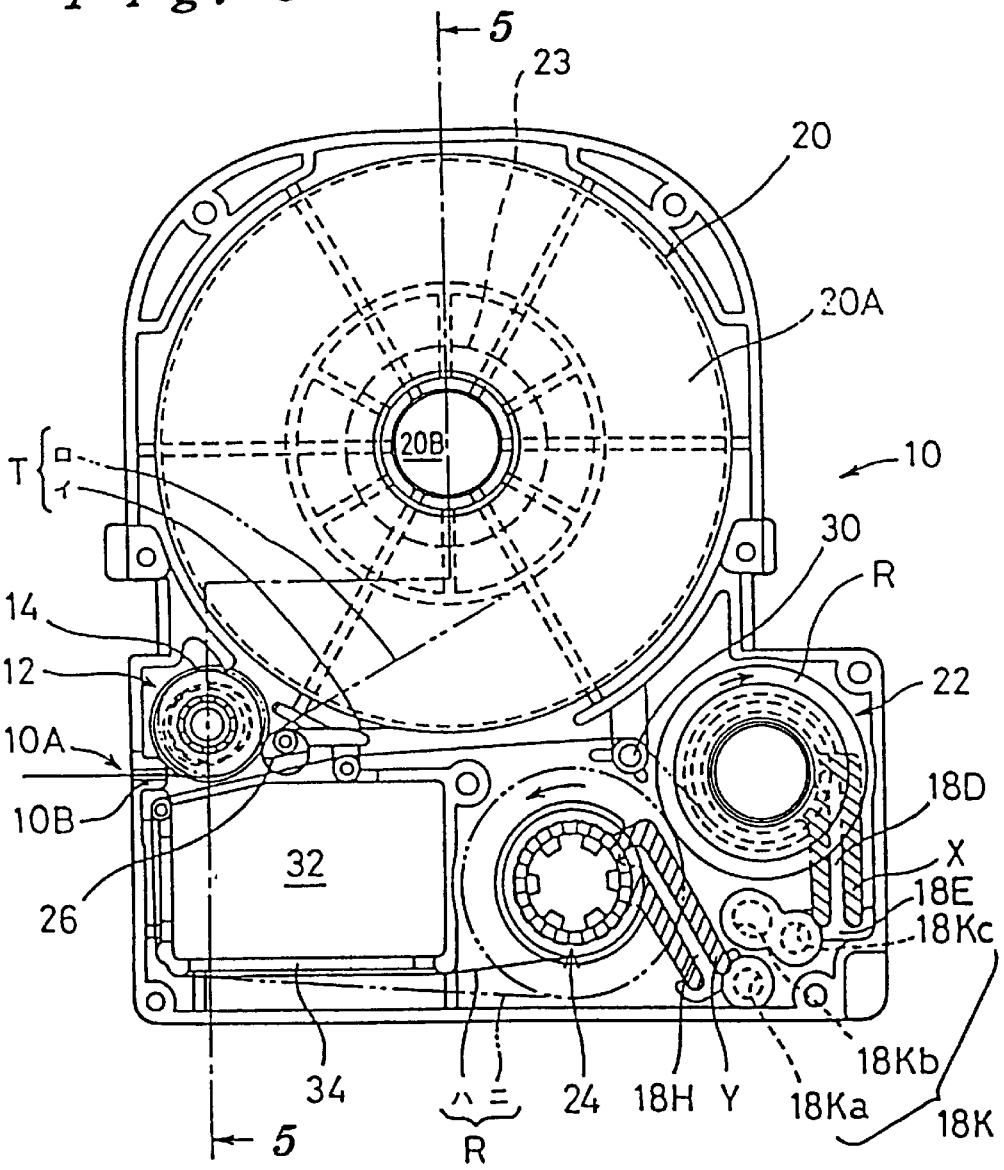
FIG. 3 is a plan view illustrating a tape cartridge 10 according to an embodiment of the present invention.

FIG. 1 is a plan view illustrating a tape writer 1 which is in a state wherein a body cover 50K is opened. FIG. 2 is a right side view illustrating the tape writer 1 with the body cover 50K closed. FIG. 3 is a plan view illustrating assembly of a tape cartridge 10 which is to be mounted on the tape writer 1. In this embodiment, a cartridge is employed which accommodates both an ink ribbon and a tape on which printing is conducted using the ink ribbon. The cartridge is therefore an ink ribbon cartridge as well as a tape cartridge, although it will hereinafter be referred to as a tape cartridge.

As shown in FIG. 1, the tape writer 1 includes a body case 50H for accommodating various parts, an input section 50C having 61 input keys, a body cover 50K which can be opened and closed, a display section 50D provided below the cover 50K in such a manner that the user can look at a string of characters or other data displayed thereon, a cartridge mounting section 50A provided at the left upper portion of the body in which a tape cartridge 10 is mounted, and a power source switch 50J. The body cover 50K has a window 50L through which the user can confirm the mounting of the tape cartridge 10, and a window 50M through which the user can look at the display section 50D, as indicated by the dashed line in FIG. 1 having two short dashes separating long single dashes. A transparent plastic plate member is fitted in each of the two windows 50L and 50M. The opening and closing of the body cover 50K is detected by an opening/closing detection switch 55 which is not shown in FIG. 1.

To use the tape writer 1, a tape cartridge must first be mounted in the unit. To mount a tape cartridge, the body cover 50K is opened and then a head moving lever 63C is turned counterclockwise as viewed in FIG. 1 by 90 degrees. The tape cartridge 10 is then mounted in the cartridge mounting section 50A. When the head moving lever 63C has been turned counterclockwise as described above, a printing head 60, which will be described later, is moved into a retracted position within a head case 60C so as to allow the tape cartridge 10 to be readily mounted in the cartridge mounting section 50A. After the tape cartridge 10 has been mounted in the mounting section 50A, the head moving lever 63C is turned clockwise to a position shown in FIG. 1. In this position, the head moving lever 63C obstructs the removal of the tape cartridge 10. The removal of the tape cartridge 10 is therefore prohibited, thus preventing damage to the printing head 60 or tape cartridge 10. After the tape cartridge 10 has been mounted, the body cover 50K is closed. In a state wherein the head moving lever 63C is turned counterclockwise such that the printing head 60 is retracted into the head case 60C, the head moving lever 63C prohibits closing of the body cover 50K, thus prohibiting a printing operation.

After the body cover 50K has been closed, the printing apparatus is switched on by operation of the power source switch 50J. After the printing apparatus has been powered up, the user inputs characters to be printed from the input section 50C and performs Kanji and Kana conversion on the input character string if necessary. When the user inputs characters by operating keys in the input section 50C, printing is performed on a tape T supplied by the tape cartridge 10 with a heat transfer type printer section 50B which will be described later. The tape T on which printing is performed is discharged from a tape discharge port 10A provided on the left side of the tape writer 1. The tape T employed in this embodiment has a printing surface which ensures excellent attachment of ink in heat transfer printing. A release tape is adhered to the sticky rear surface of the tape T. Thus, the user can affix the tape T on which characters or symbols are printed to a desired site by cutting the tape with a built-in cutter and by peeling the release tape off the rear surface of the printing tape T.

Although not shown, a battery accommodating section is provided in the rear surface of the tape writer 1. The battery accommodating section is capable of accommodating 6 UM-3 dry cells as the power source of the entire apparatus. Power can also be obtained by connection of an AC adaptor (not shown) to a plug 50 provided on the right side of the apparatus body.

The structure and function of the tape cartridge 10 will now be described with reference to FIGS. 3, 4 and 5. The tape cartridge 10 is capable of accommodating a tape T which differs in thickness, width and material from the tapes accommodated in other tape cartridges 10. These tape cartridges 10 all have a similar configuration. Regarding the shape and material of the tape T to be accommodated in the tape cartridge, there are two types of tape thicknesses, 100 μm and 200 μm, in this embodiment. With respect to the tape width, tapes of five widths, 6 mm, 9 mm, 12 mm, 18 mm and 24 mm, are available. With respect to the tape material, the embodiment offers four types of tapes, with the first type having a printing surface made of polyester and a release tape made of paper. This first type of printing tape will hereinafter be referred to as a polyester (paper) tape. The other three types of printing tape used in the present embodiment are polyester (polyester) tape, vinyl chloride (paper) tape and paper (paper) tape. In the tape having a printing surface made of polyester or vinyl chloride (hereinafter referred to as "a plastic tape"), there are four colors that may be applied to the printing surface: transparent, white, yellow and sky blue. In the tape having a printing surface made of paper (hereinafter referred to as a "paper tape"), there are four colors that may be applied to the printing surface: white, yellow and sky blue. The ink ribbon R to be accommodated in the tape cartridge 10 together with the tape T may be any one of four colors: black, red, blue, or green. Therefore, for each of the three types of plastic tapes, there are total of 160 different types (2×5×4×4) of tape cartridges which differ from each other in the thickness, width and color of the employed tape and in the color of the ink ribbon R that may be used to print on the tape. Similarly, for the paper tapes, there are 120 different types (2×5×1×3×4) of tape cartridges which differ from each other in the thickness, width and color of the employed tape and in the color of the ink ribbon R that may be used to print on the tape. That is, a total of 600 types (3×160+120) of tape cartridges are available in this embodiment. A list of such tape cartridges 10 is shown in Table 1.

TABLE 1

| | Type of tape cartridge | |
|---|---|---|
| | Plastic tape | Paper tape |
| Material | Polyester (paper)<br>Polyester (polyester)<br>Vinyl chloride (paper) | Paper (paper) |

TABLE 1-continued

| | Type of tape cartridge | |
|---|---|---|
| | Plastic tape | Paper tape |
| Thickness (μm) | 100, 200 | 100, 200 |
| Width (mm) | 6, 9, 12, 18, 24 | 6, 9, 12, 18, 24 |
| Color of tape | Transparency, White, Yellow, Sky blue | White, Yellow, Sky blue |
| Color of ink ribbon | Black, Red, Blue, Green | Black, Red, Blue, Green |

The platen 12 employed for printing is a hollow cylindrical member. In order to ensure optimum contact between the tapes T having preselected characteristics, ink ribbons R and the printing head 60, a platen rubber 14 corresponding to the type of tape T is fitted on the outer peripheral surface of the platen 12. The platen rubber 14 is made of silicon rubber. In this embodiment, a total of 32 types of platen rubbers 14 are available. In the present embodiment there are two available thicknesses of platen rubber, 1.9 mm and 2.0 mm, which correspond to the two available printing tape thicknesses. There are two available widths of platen rubber, 12 mm and 18 mm. The 12 mm platen rubber is to be used with tape widths of 6 mm, 9 mm and 12 mm, and the 18 mm platen rubber is to be used with the 18 mm and 24 mm tape widths. With respect to the hardness of the platen rubber, three types of hardness, 60 degrees, 65 degrees and 70 degrees, are available for the platen rubber having a width of 12 mm. For the platen rubber having a width of 18 mm, five types of platen rubber hardness, 40 degrees, 45 degrees, 50 degrees, 55 degrees and 60 degrees, are available. With respect to the surface roughness of the platen rubber 14, there is a rough surface (300 μm) and a smooth surface (500 μm), which are selected according to the type of release tape used with the printing tape. The unit "degree" of the hardness of the platen rubber represents the hardness of the rubber as measured by the rubber hardness meter conforming to the JIS-K6301 standard. The greater the value, the harder the rubber. Adjustments to the hardness of the platen rubber 14 are made on the basis of the results of an actual printing test. A hardness which yields excellent printing quality and printing strength in an actual test is chosen as an optimum hardness. The unit of the surface roughness of the platen rubber is μm. Table 2 is a list of platen rubbers 14 to be mounted in the tape cartridge.

TABLE 2

| | Type of platen rubber | |
|---|---|---|
| Width (mm) | 12 | 18 |
| Thickness (mm) | 1.9, 2.0 | 1.9, 2.0 |
| Hardness (degree) | 60, 65, 70 | 40, 45, 50, 55, 60 |
| Roughness (μm) | 300, 500 | 300, 500 |

Figure 6:
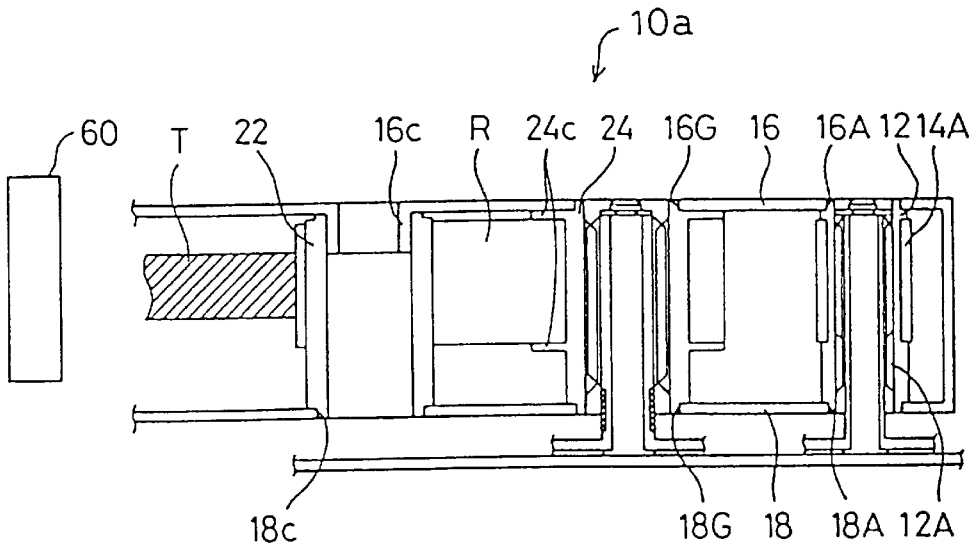
FIG. 6 is a section taken along the line which passes through the center of a tape cartridge 10*a,* the center of an ink ribbon 22, the center of a ribbon take-up core 24 and the center of a platen 12.
Figure 7:
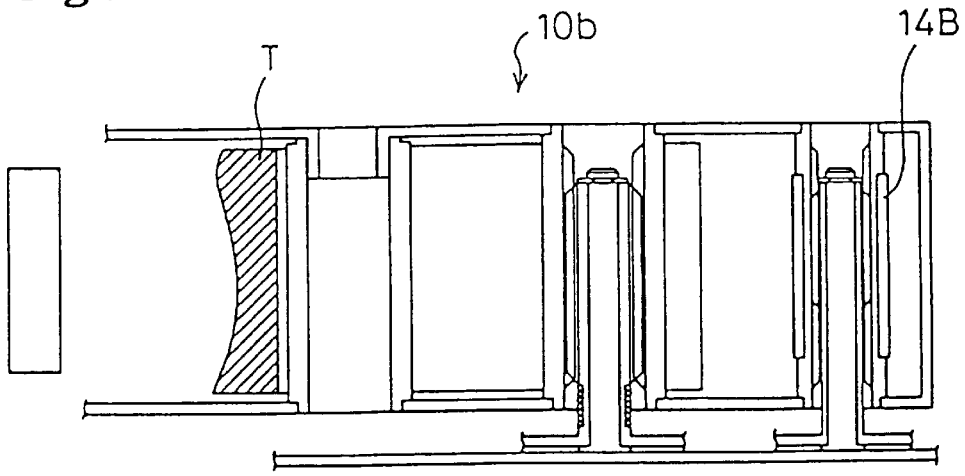
FIG. 7 is a view similar to FIG. 6, illustrating a tape cartridge 10*b;*

FIGS. 6 and 7 illustrate examples of tape cartridges in which the width of the platen rubber is varied according to the tape width. FIG. 6 is a sectional view of a tape cartridge 10*a* in which a paper tape having a thickness 100 μm and a width of 6 mm is accommodated, with the sectional view taken along a line which passes through the center of an ink ribbon core 22, the center of a ribbon take-up core 24 and the center of the platen 12. FIG. 7 is a view similar to FIG. 6 illustrating a tape cartridge 10*b* in which a paper tape having a thickness of 100 μm and a width of 24 mm is accommodated. To simplify illustration, the reference numerals in FIG. 7 are omitted. Further, in order to illustrate a mounted state of the tape cartridge on the tape writer 1, part of the printing head 60 is also shown in FIGS. 6 and 7. As shown in FIGS. 6 and 7, when a platen rubber 14 having a width corresponding to the tape width is used, the tape T can be properly conveyed.

Figure 8:
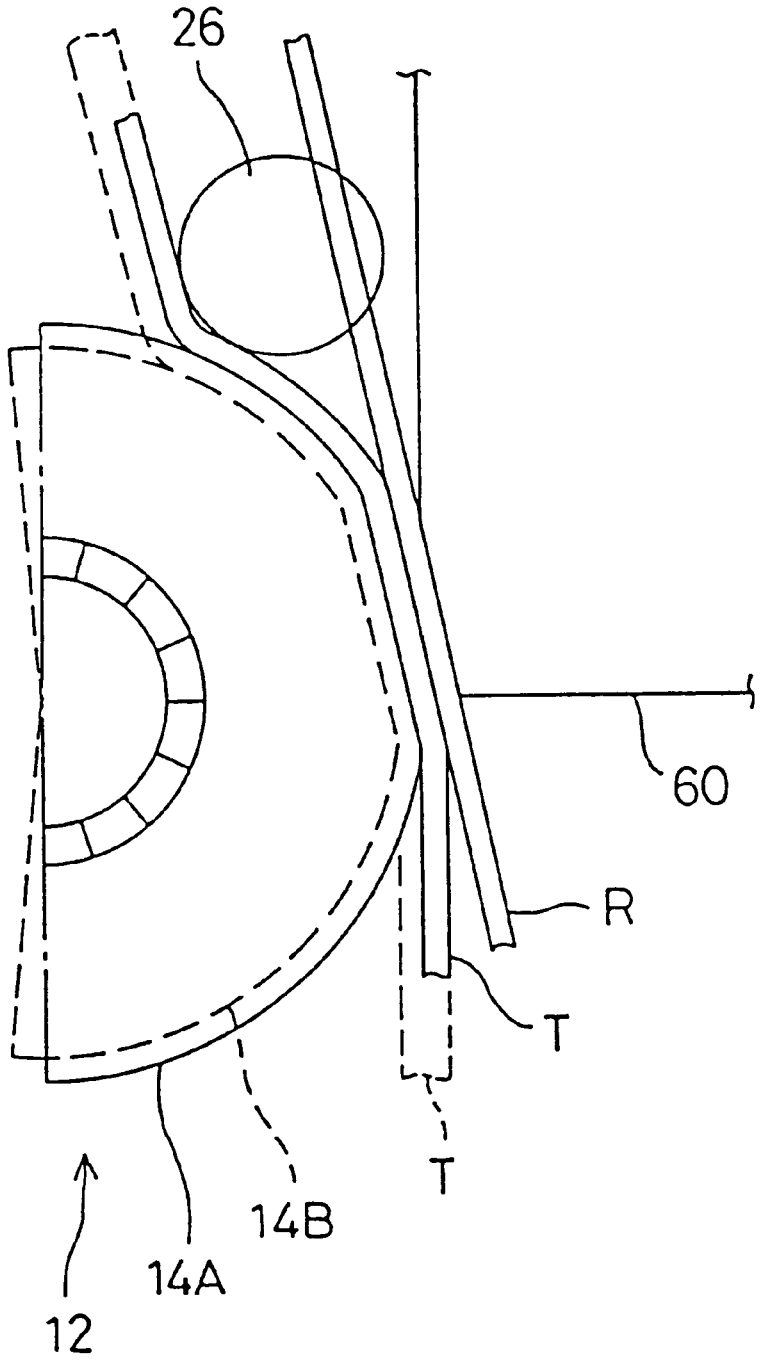
FIG. 8 is an enlarged view illustrating a section of the printing apparatus in which a tape T and an ink ribbon R are held by the platen 12 and a printing head 60.

The thickness of the platen rubber is varied according to the tape thickness to allow the platen 12 and a tape guide pin 26 to reliably convey the tape T regardless of the tape thickness and to allow the platen 12 and the printing head 60 to press and nip the tape T under a fixed pressure. FIG. 8 is an enlarged view illustrating a state wherein the tape T and the ink ribbon R are held by the platen 12 and the printing head 60. A solid line in FIG. 8 indicates a platen rubber 14A and the tape T having a thickness of 100 μm. A broken line indicates a platen rubber 14B and the tape T having a thickness of 200 μm. As shown in FIGS. 6 and 7, when a platen rubber 14 having a thickness corresponding to the thickness of the tape is used, the gap between the platen 12 and the tape guide pin 26 can be made to correspond to the thickness of the tape T, thereby enabling the tape T to be fed reliably. The gap between the platen 12 and the printing head 60 can also be made to correspond to the tape thickness T, thereby enabling the tape T and the ink ribbon R to be pressed in an optimum state during printing. Therefore, high quality printing can be achieved regardless of the thickness of the tape T.

Table 3 shows the hardness of the platen rubber 14 varies in response to changes in the hardness, thickness and width of the tape T. In Table 3, there are a total of twelve different types of soft tapes T. This can be seen by noting that for the soft printing tapes there are two types of tape materials, two thicknesses and three widths. Table 3 also lists a total of nine different types of hard tapes. This can be seen by noting that for the hard printing tapes there are a total of 3 types of hard paper tapes and a total of six types of hard plastic tapes. The column for the hardness of the platen rubber 14 shown in Table 3 indicates the hardness range which yields the highest printing quality for a particular tape T. The value at the center of the range is the most desirable and will yield the highest print quality.

| Tape hardness | Tape Material | Tape thickness (μm) | Tape width (mm) | Hardness of platen rubber (degree) |
|---|---|---|---|---|
| Soft | Polyester (Polyester) | 100 | 12 | 70 ± 10 |
| | | | 18 | 60 ± 10 |
| | | | 24 | 50 ± 10 |
| | Paper (Paper) | 200 | 12 | 65 ± 10 |
| | | | 18 | 55 ± 10 |
| | | | 24 | 45 ± 10 |
| Hard | Paper (Paper) | 100 | 12 | 65 ± 10 |
| | | | 18 | 55 ± 10 |
| | | | 24 | 45 ± 10 |
| | Polyester (Paper) | 200 | 12 | 60 ± 10 |
| | | | 18 | 50 ± 10 |
| | Vinyl chloride (Paper) | | 24 | 40 ± 10 |

Figure 9:
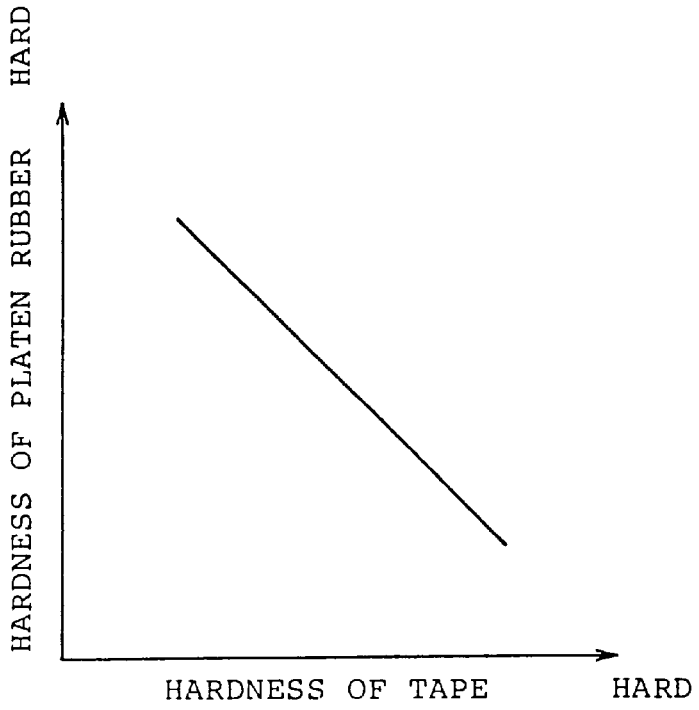
FIG. 9 is a graphic representation showing the relationship between the hardness of the tape T and the hardness of a platen rubber 14.
Figure 10:
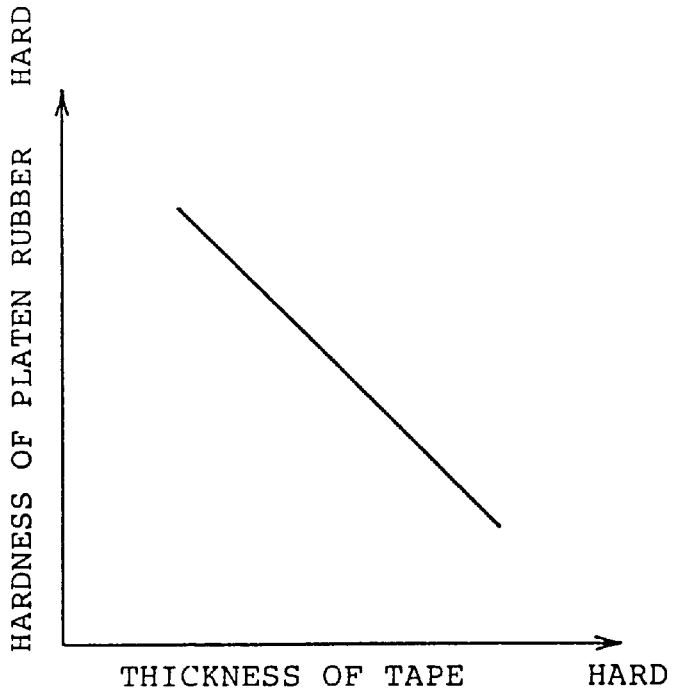
FIG. 10 is a graphic representation showing the relationship between the thickness of the tape T and the hardness of the platen rubber 14.
Figure 11:
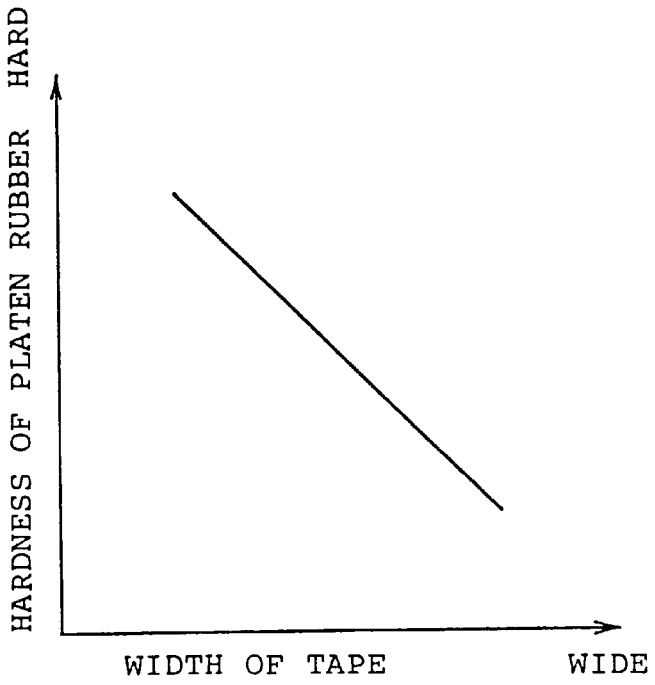
FIG. 11 is a graphic representation showing the relationship between the width of the tape T and the hardness of the platen rubber 14.

As indicated in Table 3, if the hardness and thickness of the tape T are held constant, the wider the tape, the softer the platen rubber 14. If the hardness and width of the printing tape T are held constant, the thicker the tape, the softer the platen rubber 14. If the thickness and width of the tape T are held constant, the harder the tape, the softer the platen rubber 14. The pressing force of the printing head 60, obtained when the tape cartridge is mounted in the tape writer 1, is determined by a spring which presses the printing head 60 toward the platen and is fixed regardless of the width of the tape T. Thus, if a wide tape T is used, the pressing force of the printing head 60 per unit area is reduced, and the print quality decreases as a result of this non-ideal contact state. In order to compensate for this, a soft platen rubber 14 is employed to ensure an optimal contact state between the printing head 60 and the tape T, with the platen rubber 14 becoming softer with increasing tape width. Similarly, in order to obtain an excellent contact state between the printing head 60 and the tape T, the platen rubber softness is also increased in response to increasing thickness or hardness of the tape T. FIGS. 9, 10 and 11 are graphic representations showing the relationships between the hardness, thickness and width of the tape T and the hardness of the platen rubber 14. It is therefore possible to employ in the present embodiment a platen rubber 14 having a hardness suited to the tape T having arbitrary properties selected from a quaternary map of relations between the hardness, thickness and width of the tape T and the hardness of the platen rubber 14. The platen rubber hardness is thus selected to ensure the highest quality printing under various conditions.

In this embodiment, when the tape T having a release tape made of paper is used, a platen rubber 14 having a smooth surface (500 μm) is used. When the release tape is made of polyester, a platen rubber 14 having a rough surface (300 μm) is used. In each case, the platen rubber 14 is made of silicon rubber. If the surface of the platen rubber 14 is smooth and if the tape cartridge 10 has been mounted in the tape writer 1 for a long time, the platen rubber 14 may lightly adhere to a polyester release tape. When printing is performed in that adhered state, the tape T may not be discharged smoothly from the tape discharge port 10A and may become jammed in the tape cartridge 10. Therefore, a platen rubber 14 having a rough surface is employed so as to prevent adherence of the platen rubber 14 to the polyester release tape. Thus, the surface roughness of the platen rubber 14 is determined by both the material and surface roughness of the release tape of the tape T.

Figure 12:
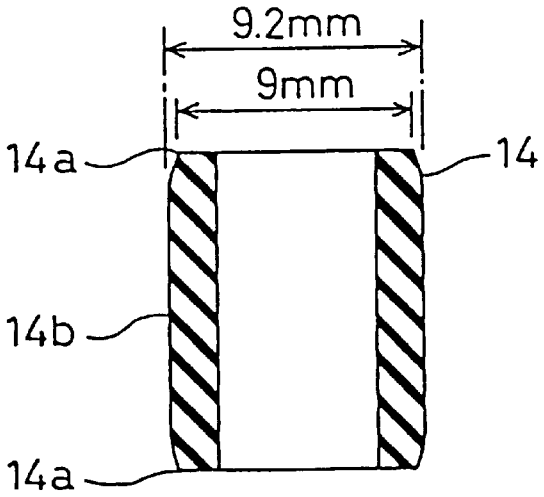
FIG. 12 is an enlarged cross-sectional view of the platen rubber 14.

FIG. 12 is a section taken from the plane which lies along the axis of the platen rubber 14 having an outer diameter of 9 mm and a width of 12 mm. As shown in FIG. 2, the platen rubber 14 has a barrel shape whose central portion 14*b* has an outer diameter of 9.2 mm and whose two end portions 14*a* have an outer diameter of 9.0 mm. In a platen rubber 14 whose two end portions 14*a* have an outer diameter greater than the outer diameter of the central portion 14*b*, the conveyed tape T or the ink ribbon R may shift from the central portion 14*b* to one of the end portions 14*a*, making stable conveyance impossible. Such a problem can be eliminated if the outer diameter of the central portion 14*b* is larger than the outer diameter of the two end portions 14*a*. Manufacture of a platen rubber 14 whose central portion 14*a* has the same outer diameter as the two end portions 14*a* may also be considered. However, it may result in the manufacture of a platen rubber whose central portion 14*b* has an outer diameter slightly smaller than that of the two end portions 14*a* due to variations in the manufactured products. Such a platen rubber 14 would also suffer from the above-described problem of unstable conveyance. In this embodiment, the outer diameter of the central portion 14*b* of the platen rubber 14 is 0.2 mm greater than the outer diameter of the two end portions 14*a*. It is desired that the outer diameter of the central portion 14*b* be larger than that of the two end portions 14*a* by 1 to 3%. If the outer diameter of the central portion 14*b* is larger than the outer diameter of the two end portions 14*a* by more than 3%, the force with which the two end portions 14*a* press the tape T against the printing head 60 becomes too small, resulting in printing failures such as faint characters. A platen rubber 14 having a width of 18 mm also has the same barrel shape.

The upper and lower end portions of the platen 12 on which the above-described platen rubber 14 is fitted have a diameter slightly smaller than that of the other portion of the platen 12. These small-diameter portions are loosely and pivotally fitted into engagement holes 16A and 18A formed respectively in a ceiling wall 16 and a bottom wall 18 of the tape cartridge 10, whereby the platen 12 is made pivotal. The engagement holes 16A and 18A have a substantially elliptical form, as shown in FIGS. 3 and 4. The platen 12 provided upright in the tape cartridge 10 in the manner described above can be mounted on and removed from a platen driving shaft provided in the tape writer 1. The platen driving shaft will be described later. In order to allow the rotational driving force of the platen driving shaft to be transmitted to the platen 12 in a state wherein the platen 12 is in engagement with the driving shaft, six engaging grooves 12A are formed on the inner peripheral surface of the hollow portion of the platen 12 in the direction of the rotational axis of the platen, as shown in FIGS. 4 and 6.

In addition, the tape cartridge 10 has the tape core 20, the ink ribbon core 22 and the ribbon take-up core 24 raised thereon for compactly winding up and storing the elongated tape T and ink ribbon R. Further, the tape cartridge 10 is formed with an inserting hole 32 through which a printing head to be described later is inserted. A guide wall 34 is formed on the periphery of the inserting hole 32.

The tape core 20 is formed as a hollow cylindrical reel having a relatively large diameter so that a tape T having a large length may be taken up and stored compactly. Accordingly, the angular speed of rotation of the tape core 20 in drawing out the tape T located on the outermost circumference (indicated by "a" in FIG. 3) is not largely different from the angular speed of rotation of the tape core 20 when the tape T located on the innermost circumference (indicated by "b" in FIG. 3) is drawn out at the same rate. Further, since the curvature of the wound tape is small, storage is possible without excessive strain even if the material of the tape T is vulnerable to bending stress.

Figure 5:
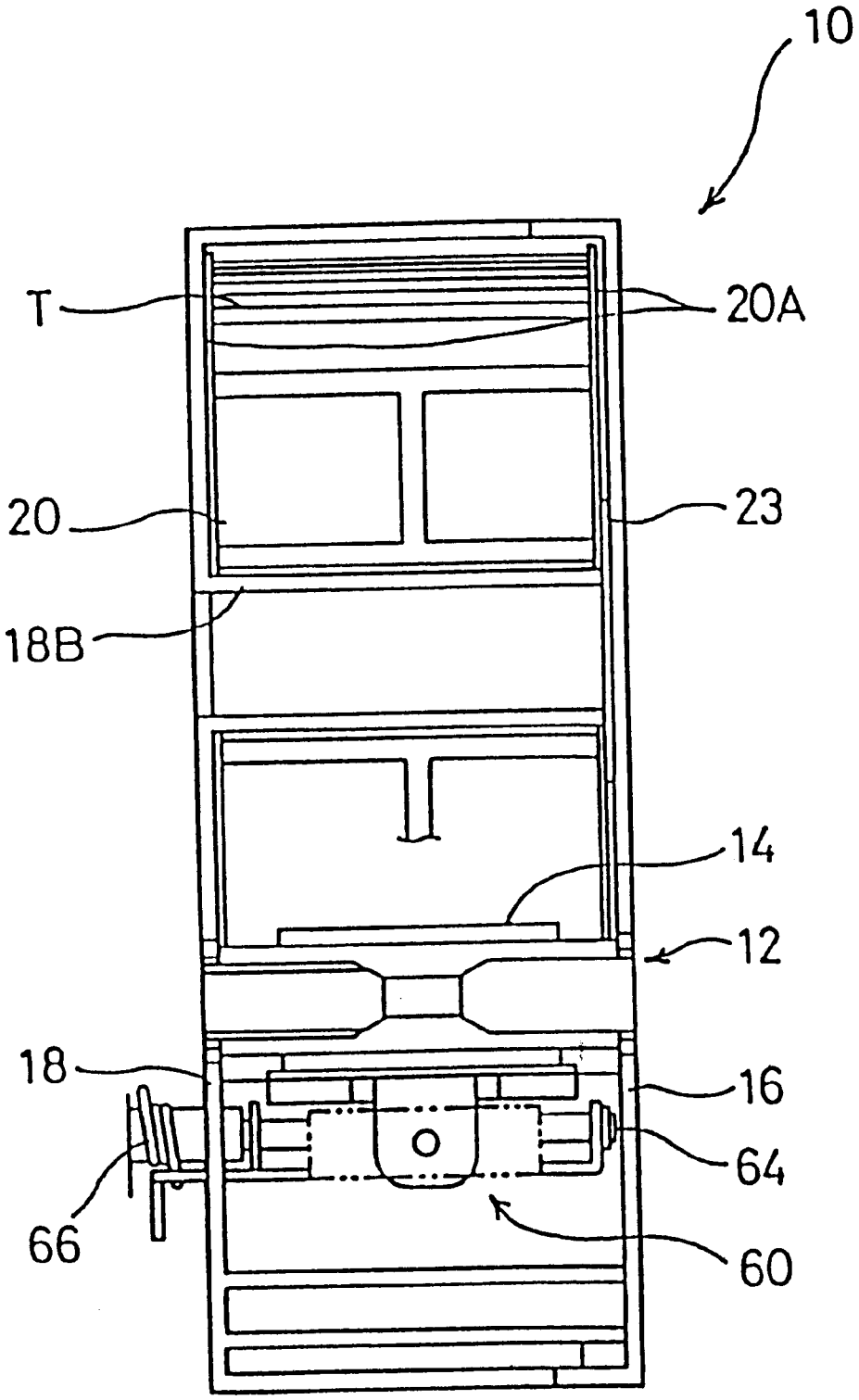
FIG. 5 is an end view illustrating the tape cartridge 10 and taken in a direction indicated by arrows A—A of FIG. 3.

As shown in FIG. 5, the tape core 20 has a shaft hole 20B formed at the center thereof so as to be fitted onto a shaft body 18B which is raised from the bottom wall 18 of the tape cartridge 10. Circular thin films 20A are affixed to upper and lower ends axially of the tape core 20, with their surface toward the tape T being formed as an adhesive layer. Each film 20A serves as a flange for the tape T. Since each film has an adhesive layer on the side toward tape T, the butt ends of tape T are lightly adhered to the films 20A. Accordingly, when the tape T is drawn out by a rotation of the platen 12 to cause a following rotation of the tape core 20, the tape T on the core will not be loosened.

The tape T wound and stored around the tape core 20 reaches the platen 12 via a tape guide pin 26 which is raised from the bottom wall 18 of the tape cartridge 10. From the platen 12, the printing tape is drawn to the exterior of the cartridge from the tape outlet 10A of the tape cartridge 10. A guide portion 10B with a predetermined length is formed at the portion of the tape outlet 10A along the transporting direction of tape T. In the state where the tape cartridge 10 is mounted on the cartridge mounting section 50A, the printing head 60 is located in the inserting hole 32. In this state, the tape T is nipped between the printing head 60 and the platen 12, and the transportation of the tape T is effected by a rotation of the platen 12. At this time, since the thickness of the platen rubber 14 attached to the platen 12 corresponds to the thickness of tape T, the tape T is brought into the same contacting state, irrespective of its thickness, with the printing head 60 through the ink ribbon R.

Since the fitting holes 16A and 18A into which the upper and lower end portions of the platen 12 are fitted are formed as having an elliptical cross section, the platen 12 may be moved along the longitudinal axes of the fitting holes 16A and 18A when the tape cartridge 10 exists by itself as a single unit. Accordingly, if an attempt is made to push the tape T into the tape cartridge 10 from the outside of the tape cartridge 10, the platen 12 is moved along the transporting path of the tape T by the movement of the tape T. Upon the movement of the platen 12, the platen rubber 14 of the platen 12 abuts against the outer periphery of the tape guide pin 26 and nips the tape T between it and the tape guide pin 26. As a result, the tape T cannot be moved any further and the tape T will not be pushed into the tape cartridge 10.

Figure 13:
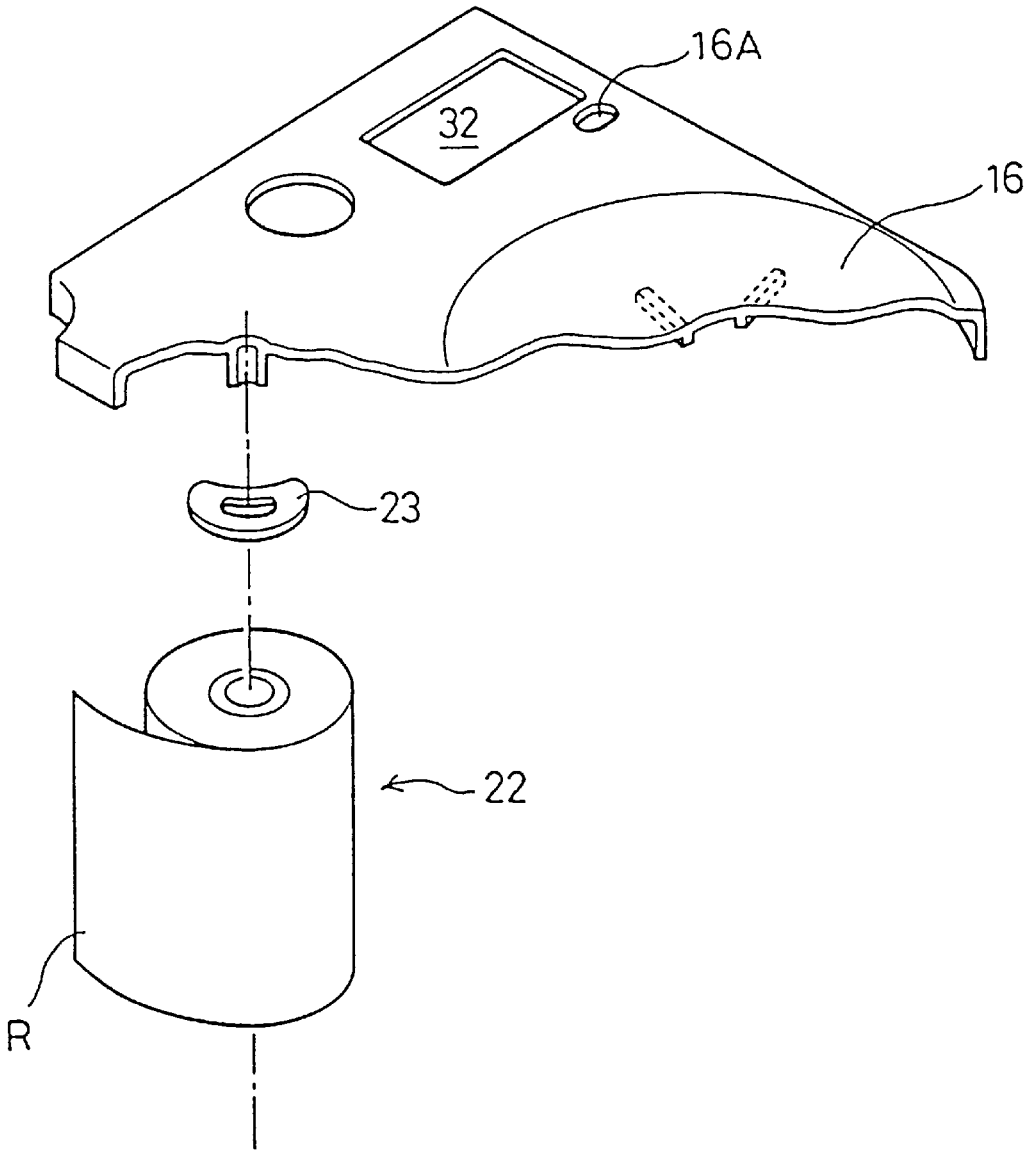
FIG. 13 is a perspective view illustrating a structure for restricting free rotation of the ink ribbon core 22.

The ink ribbon core 22 is constructed of a smaller-diameter hollow cylindrical member as shown in FIGS. 6 and 7, the outer circumference of the upper and lower end portions thereof being slightly reduced in diameter. On the end surface of the reduced-diameter lower end portion, six equally spaced grooves are formed in the axial direction thereof as shown in FIGS. 3 and 4, so as to constitute an engaging portion 22A. This reduced-diameter portion toward the lower end is loosely fitted into a circular fitting hole 18C formed on the bottom wall 18 of the tape cartridge 10. Further, an upper end hollow portion of the ink ribbon core 22 is loosely fitted onto a circular cylindrical guide projection 16C protruding from the ceiling wall 16 of the tape cartridge 10. In this state, the ink ribbon core 22 is held in a manner allowing it to rotate as the ink ribbon R is drawn out. It should be noted that a circular ring washer 23 is placed as shown in FIG. 13 between a lid body forming the ceiling wall 16 of the tape cartridge 10 and the ink ribbon core 22. The free rotation of the ink ribbon core 22 is regulated as the ink ribbon core 22 is pressed toward the bottom wall 18 by a deformation of the circular ring washer 23.

Figure 4:
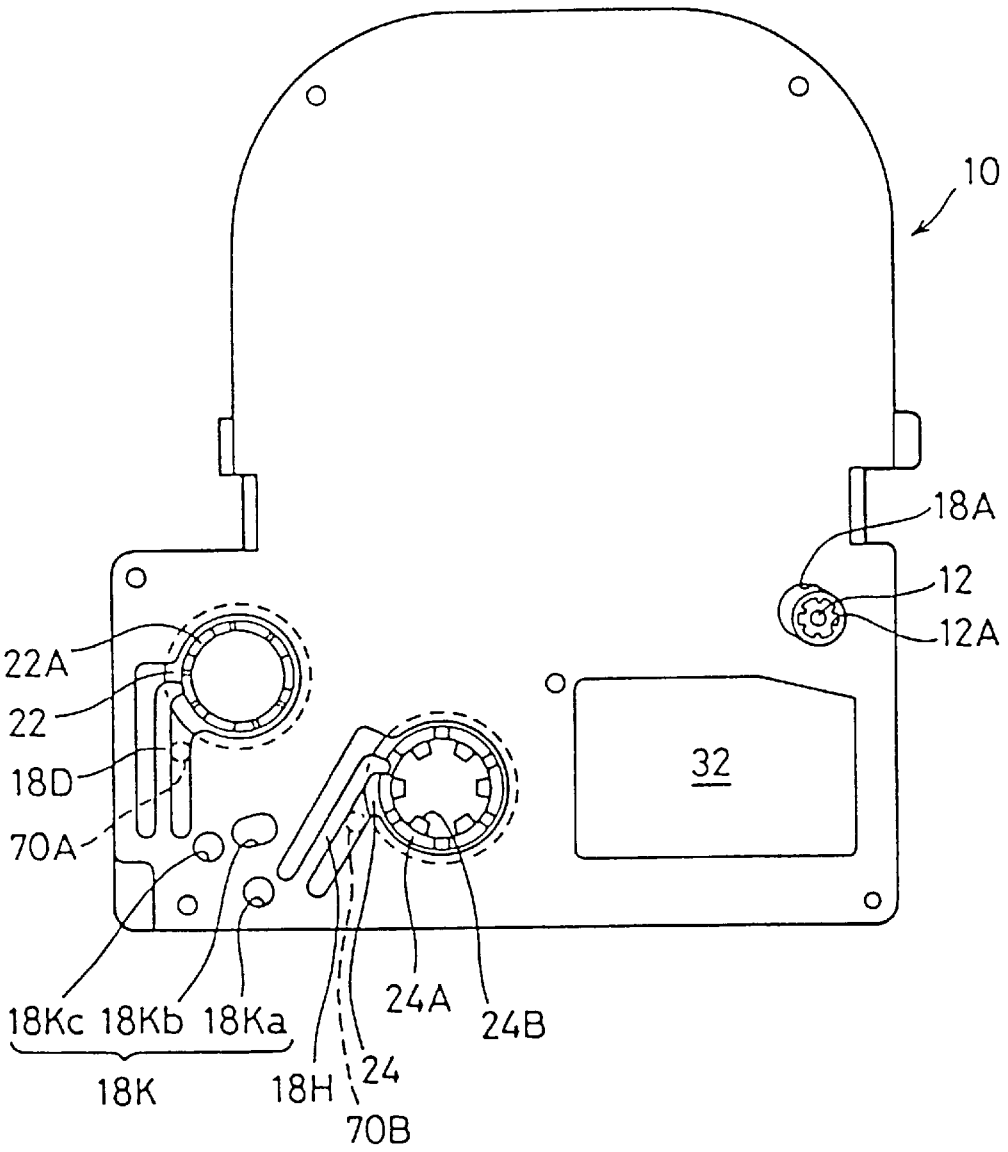
FIG. 4 is a bottom view of the tape cartridge 10 of FIG. 3.

Further, as shown in FIGS. 3 and 4, a slender and generally L-shaped engaging piece 18D is formed on the bottom wall 18 of the tape cartridge 10 in the vicinity of the bottom portions of the ink ribbon core 22 and the ribbon take-up core 24. The engaging piece 18D is formed by boring through a portion of the bottom wall 18 (hatch portion X as shown in FIG. 3) of the tape cartridge 10. Accordingly, the end portion of the engaging piece 18D can be moved along the plane of the bottom wall 18 about the base end portion 18E. In a state where no force is acting upon the engaging piece 18D, the movable end portion of the engaging piece is positioned within the outer circumference of the fitting hole portion 18C and the engaging piece engages one of the six engaging portions 22A formed on an end portion of the ink ribbon core 22. This engagement prevents rotation of the ink ribbon core 22.

The ink ribbon R as supplied is wound and stored around the ink ribbon core 22 and is laid upon the above described tape T and reaches the platen 12 as guided by a ribbon guide roller 30. Further, the ink ribbon R reaches the ribbon take-up core 24 via a guide wall 34 formed on a peripheral surface of the inserting hole 32 through which the printing head enters. The pulled around state of the ink ribbon R in the unused state of the tape cartridge 10, i.e., when only the starting end of the ink ribbon R is wound around the ribbon take-up core 24 is indicated by "c" in FIG. 3, while the state at the time when all the ink ribbon has been taken up to the ribbon take-up core 24 is indicated by "d".

As shown, the ribbon take-up core 24 is constituted by a hollow circular cylindrical member of substantially the same type as the ink ribbon core 22. Further, the circumferences of the upper and lower end portions thereof are also slightly reduced in diameter in a similar manner as the ink ribbon core 22. Six engaging portions 24A are indented at equal intervals on an end surface of the lower end reduced-diameter portion. Six engaging stripes 24B are equidistantly formed on the ribbon take-up core 24 in the axial direction on the inner circumference of its hollow portion, so that it may be rotated in a similar manner as the platen 12 by engaging a ribbon take-up core driving shaft which is provided on the tape writer 1 and will be described later. The ribbon take-up core 24 constructed in this manner is loosely fitted by inserting its reduced diameter portions formed at the upper and lower ends thereof into circular fitting hole portions 16G and 18G formed on the bottom wall 18 and the ceiling wall 16 of the tape cartridge 10.

Further, in order to prevent an accidental rotation of the ribbon take-up core 24, a slender and generally L-shaped engaging piece 18H having an end portion thereof located within the outer circumference of the fitting hole portion 18G is formed in a similar manner as described above on the bottom wall 18 of the tape cartridge 10. That is, the engaging piece 18H is formed by boring through a portion of the bottom wall 18 (hatch portion Y in FIG. 3) of the tape cartridge 10. In the state where the tape cartridge 10 stands alone, the end portion of the engaging piece 18H engages one of the six engaging portions 24A formed at an end portion of the ribbon take-up core 24, whereby a rotation of the ribbon take-up core 24 is prevented. Since the terminal ends of the engaging pieces 18D and 18H respectively face the engaging portions 22A and 24A in an oblique, as opposed to a perpendicular, direction, it is possible for the ink ribbon core 22 and the ribbon take-up core 24 to be rotated counterclockwise.

Such engagement between the engaging portion 22A of the ink ribbon core 22 and the engaging piece 18D and the engagement between the engaging portion 24A of the ribbon take-up core 24 and the engaging piece 18H are both released upon mounting of the tape cartridge 10 onto the cartridge mounting section 50A. The operation thereof will be described later together with the structure of the cartridge mounting section 50A.

The ink ribbon R to be taken up by the ribbon take-up core 24 is a ribbon of the thermal transfer type, with several available widths being provided corresponding to the width of the tape T to be printed. In the present embodiment, the ink ribbon R is provided in three widths: an ink ribbon that is 12-mm wide as shown in FIG. 6 for the tape widths of 6, 9, 12 mm; an ink ribbon that is 18-mm wide (not shown) for the tape width of 18 mm; and an ink ribbon that is 24-mm wide as shown in FIG. 7 for the tape width of 24 mm.

If the ribbon width of the ink ribbon R is equal to the height of the tape cartridge 10 (see FIG. 7), the ink ribbon R is guided by the ceiling wall 16 and the bottom wall 18 of the tape cartridge 10 and no flange portion is formed on the outer circumference of the ribbon take-up core 24. For a tape cartridge 10 with a narrow ribbon width, a flange portion 24C suitable for the width of the wound and stored ink ribbon R is formed on the outer circumference of the ribbon take-up core 24 so that the ink ribbon R may be stably supplied to the platen 12. The ink ribbon R is guided by the flange portion 24C (see FIG. 6).

In the present embodiment, the hardness of the platen rubber 14 is varied to correspond to a particular width of ink ribbon R. This correspondence is shown in Table 4. In Table 4, the thickness, width and material of the tape T are held constant to facilitate understanding of the relationship between the width of the ink ribbon R and the hardness of the platen rubber 14. In the table, a paper tape (paper (paper)) having a thickness of 100 μm and a width of 18 mm and a plastic tape (polyester (paper)) having a thickness of 200 μm and a width of 18 mm are used as the tape T. For these tapes, the median hardness for the platen rubber 14 and the appropriate hardness range is shown. The indicated platen rubber hardness will yield the highest quality printing for the indicated combinations of printing tapes T and ink ribbons R.

TABLE 4

Width of ink ribbon and hardness of platen rubber

| Material of Tape | Thickness (μm) | Width (mm) | Width of ink ribbon (mm) 12 mm | 18 mm | 24 mm |
|---|---|---|---|---|---|
| Paper (paper) | 100 | 18 | 65 ± 10 | 60 ± 10 | 55 ± 10 |
| Polyester (paper) | 100 | 18 | 55 ± 10 | 50 ± 10 | 45 ± 10 |

Figure 14:
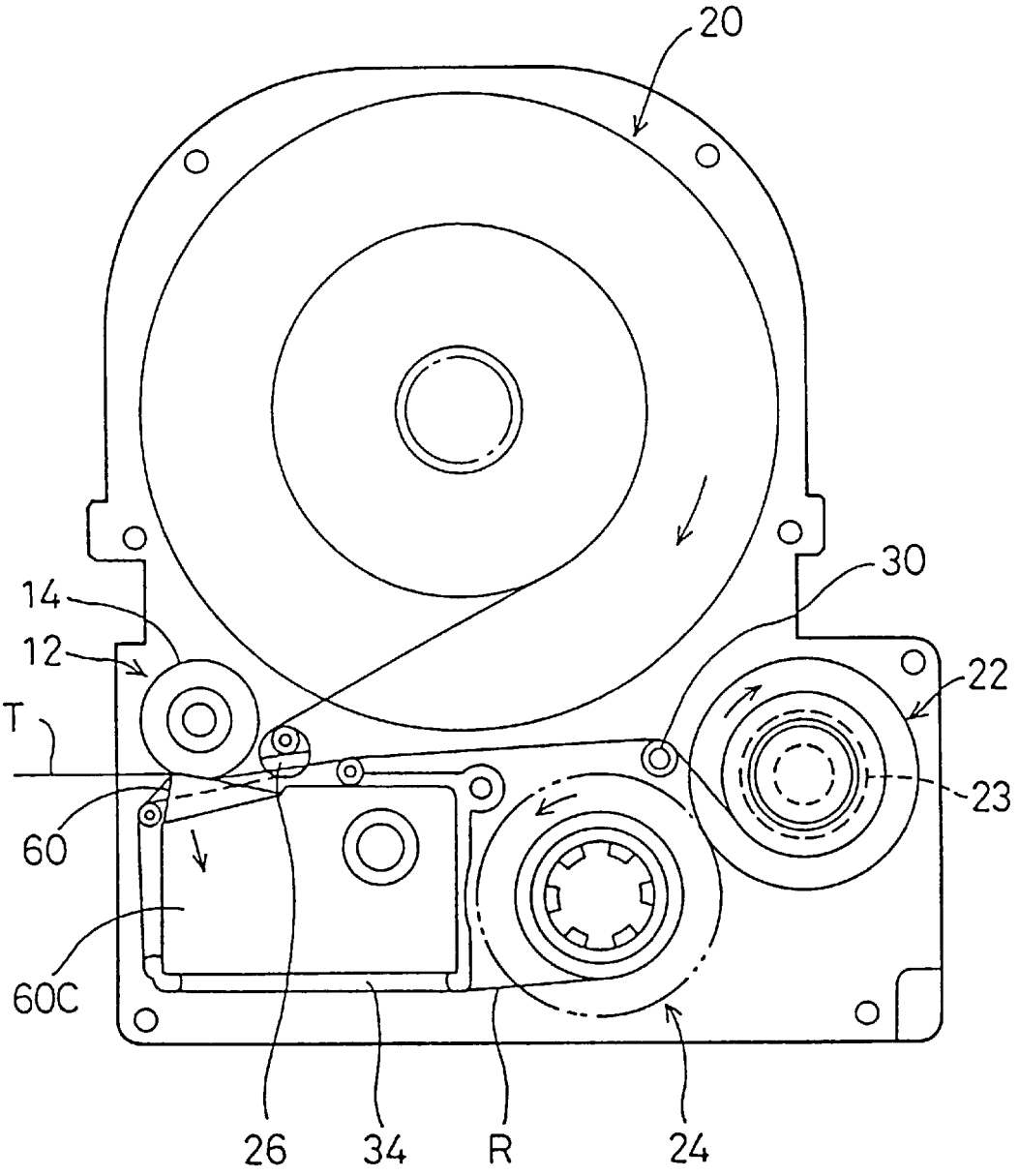
FIG. 14 illustrates the tape T and the ink ribbon R which are in a state where printing can be performed on the printing tape by the printing head 60.

As shown in Table 4, the wider the of ink ribbon R, the softer the platen rubber 14. The reason for this is as follows. FIG. 14 depicts the state where the tape cartridge has been mounted onto the tape writer and printing by the printing head 60 is possible. In this state, the ink ribbon R is guided by the ribbon guide roller 30 from the ink ribbon core 22 the rotation of which is regulated by the circular ring washer 23. The ink ribbon R is then nipped between the platen 12 and the printing head 60 together with the tape T. The ink ribbon R reaches the ribbon take-up core 24 via the guide wall 34 formed on the peripheral surface of the head case 60C. To obtain high quality printing, a certain tension, i.e., a predetermined range of tensile force per unit width (for example, 1.1 gf/mm to 1.7 gf/mm) is required in the ink ribbon R directed along its length. Such tensile force may be obtained by introducing a frictional force which acts in the direction opposite to the rotation of the ink ribbon core 22. This opposing frictional force is introduced as the circular ring washer 23 in the form of a curved thin plate is pressed between the ink ribbon core 22 and the ceiling wall 16. The magnitude of the frictional force may be adjusted by manipulating the curvature of the circular ring washer 23 or by adjusting its thickness. Since the ink ribbon R requires a predetermined tensile force per unit width, the overall tensile force is increased as the width of the ink ribbon R is increased.

In the state where printing by the printing head 60 is possible, the printing head 60 pushes the ink ribbon R indicated by a broken line in the figure up to the position of the platen 12. When the ink ribbon R and the printing head 60 are in this position, a force due to the tension of the ink ribbon R acts on the printing head 60 in a direction away from the platen ( this direction is indicated by an arrow in the figure). The pressing force of the printing head 60 against the platen 12 is thereby reduced by an amount corresponding to such force. As previously described, the circular ring washer 23 is adjusted so that the tensile force per unit width of the ink ribbon R falls in a predetermined range, and the pressing force of the printing head 60 against the platen 12 is thereby decreased as the width of ink ribbon R and the total tensile force is increased. Accordingly, if platen rubbers 14 of the same hardness are used for ink ribbons R that are different in width, the extent of the deformation of the platen rubber 14 decreases as the width of ink ribbon R increases, since the pressing force of the printing head 60 against the platen 12 decreases as the width of the ink ribbon R increases. The result of this decreased pressure and decreased deformation of the platen rubber 14 is that the position of balance between the platen 12 and the print head 60 moves toward the print head. As a result, the platen 12 transports more tape per unit time which leads to a decline in print quality.

Therefore, by using a softer platen rubber 14 as the width of ink ribbon R is increased, a constant level of deformation of the platen rubber 14 is achieved irrespective of the width of the ink ribbon R. The ideal position of balance is thus maintained between the printing head 60 and the platen 12. As a result a uniform amount of the tape T is transported per unit time, thereby preventing any degradation in print quality.

In the present embodiment, 600 types of tape cartridges 10 result if all the combinations of thickness, width and material of the stored tape T and colors of the ink ribbon R as described are counted. Since the area which may be printed differs when the width of tape T is different, it becomes necessary to detect the width of a tape cartridge 10. In the tape cartridge 10 of the present embodiment, three detecting holes 18K*a,* 18K*b* and 18K*c* are provided on the bottom wall 18 of the cartridge to enable discrimination of each type of tape cartridge 10. That is, the detecting holes 18K*a,* 18K*b,* 18K*c* are formed to have a different depth corresponding to the width of the wound and stored tape T. Accordingly, by providing a sensor for detecting the depth of the detecting holes 18K, a maximum of seven different tape widths of the cartridge 10 may be discriminated from each other.

Figure 15:
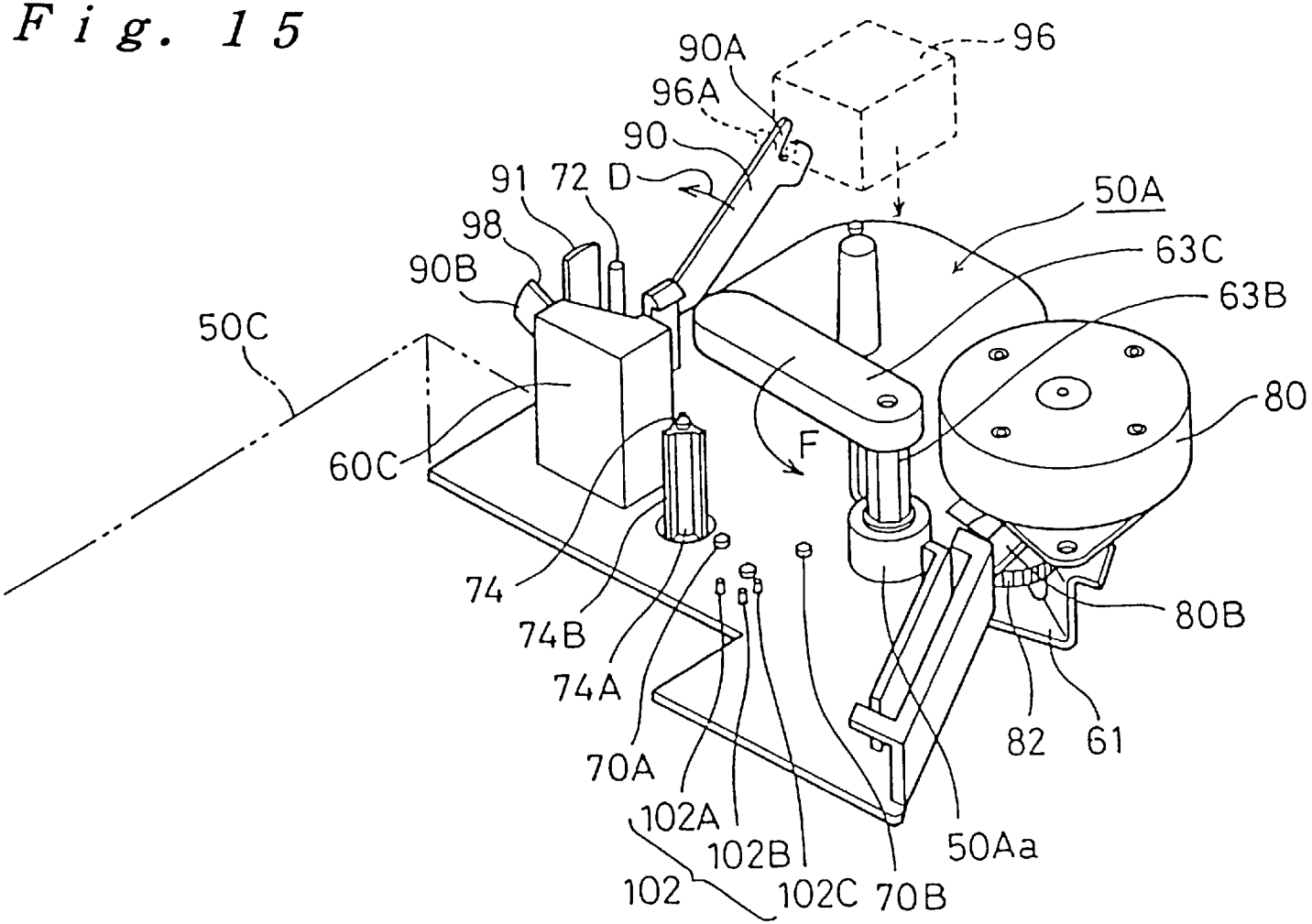
FIG. 15 is a perspective view of a cartridge mounting section 50A.
Figure 16:
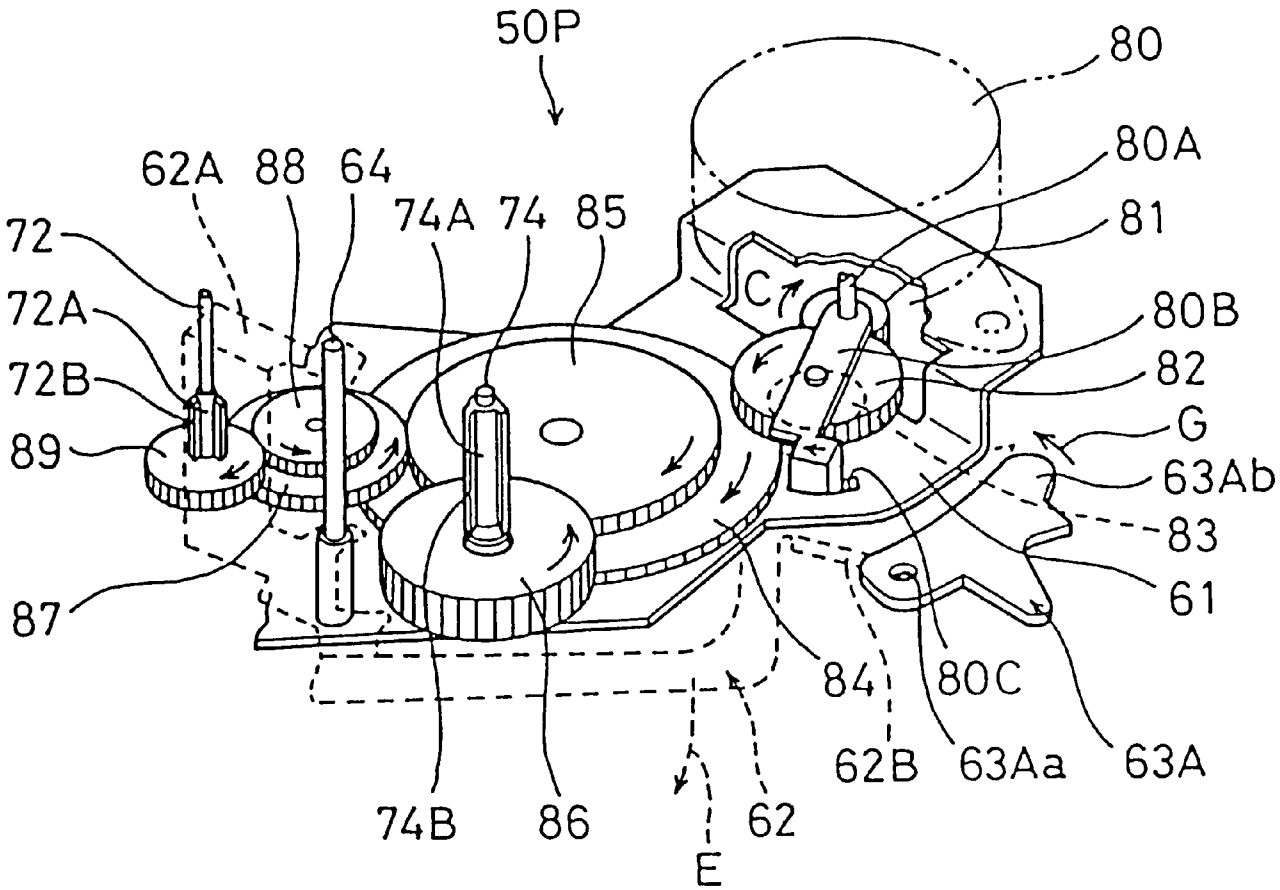
FIG. 16 is a perspective view illustrating a gear train and a mechanism for moving the printing head 60 between a retracted position and a printing position.

The tape cartridge 10 as described in detail above is mounted onto the cartridge mounting section 50A of the tape writer 1. Each of the structural portions of the tape writer 1 will be described below in a sequential order. FIG. 15 is perspective view schematically illustrating the construction in the vicinity of the cartridge mounting section 50A. The cutter button 96 for cutting a printed tape T is represented by a broken line. FIG. 16 is a perspective view where the construction of certain portions of the drive mechanism 50P for driving elements such as the platen 12 with a stepping motor 80 is represented by the solid line while a turning frame 62 which is turned about the head rotary shaft 64 by a turning operation of the head moving lever 63C is represented by the broken line.

The cartridge mounting section 50A is located to the rear of the input section 50C on the left side of the display section 50D, i.e., the back side toward the left of the body of the tape writer 1. As shown in FIG. 15, the mounting section 50A is formed as a mounting space suitable for accommodating the shape of the above described tape cartridge 10. Raised in this mounting space are the shafts for engaging the respective hollow portions of the ribbon take-up core 24 and platen 12, and the printing head 60. Further, a baseboard 61 is attached by means of screw to the lower portion of the cartridge mounting section 50A. Disposed on the base board 61 are the drive mechanism 50P as shown in FIG. 16 and the tape cutter 90 as shown in FIG. 15. In its normal state, the baseboard 61 is partitioned by the case of the cartridge mounting section 50A and elements such as the drive mechanism 50P cannot be directly viewed by merely opening the body cover 50K. FIG. 16 is an illustration where the case is removed and the drive mechanism 50P is depicted. Furthermore, the broken lines in FIG. 16 represent the turning frame 62 and the cam member 63A for moving the head body 65 to its printing position or retracted position in accordance with the operation of the previously described head moving lever 63C.

Mounting or replacing of the tape cartridge 10 at the cartridge mounting section 50A is performed by opening the body cover 50K. Engagement between the body cover 50K and the body is released when a slide button 52 (see FIG. 1) provided in front of the cartridge mounting section 50A is slid to the right. The body cover 50K may be opened as it turns about a cover hinge 54 located at the rear portion of the body.

As already described, the engaging pieces 18D and 18H are provided on the bottom wall 18 of the tape cartridge 10 to prevent undesired rotation of the ink ribbon core 22 and ribbon take-up core 24. The engaging pieces 18D and 18H are formed by boring through certain portions (hatch portions X and Y as shown in FIG. 3) of the bottom wall 18. Two wedge-like abutting projections 70A and 70B are raised as shown in FIG. 15 on the portions of the cartridge mounting section 50A corresponding to the positions of the hatch portion X and the hatch portion Y, respectively. Therefore, when the tape cartridge 10 is mounted on the cartridge mounting section 50A, the abutting projections 70A and 70B are fitted into the hatch X and hatch Y so that the mounting operation presses the engaging pieces 18D and 18H in a direction away from the end portions of the ink ribbon core 22 and the ribbon take-up core 24. Thereby, the respective engagement of the engaging pieces 18D and 18H is released and the ink ribbon core 22 and ribbon take-up core 24 are brought into their rotatable state.

A description will be given below of the transmission mechanism for transmitting rotation of the stepping motor 80 to elements such as the platen driving shaft 72 of the platen 12. As shown in FIG. 16, a first gear 81 is attached to a rotating shaft 80A of the stepping motor 80, and a clutch arm 80B is fitted onto the rotating shaft 80A with a predetermined friction therebetween. A second gear 82 for meshing with the first gear 81 and a third gear 83 formed concentrically and integrally with the second gear 82 (indicated by a broken line in FIG. 16 as it is hidden below the second gear 82) are attached to the clutch arm 80B, thereby forming a one way clutch with a fourth gear 84 having a diameter which is larger than that of the first three gears and which meshes with the third gear 83. Upon the rotation of the stepping motor 80 in the direction of arrow C as shown in the figure, the clutch arm 80B rotates in the direction of arrow C together with the second and third gears 82 and 83 due to friction between the rotating shaft 80A and clutch arm 80B, so as to engage the fourth gear 84. As a result, rotation of the stepping motor 80 is transmitted to the fourth gear 84. Operation of the one way clutch will be described later.

Upon rotation of the fourth gear 84, a fifth gear 85 formed concentrically and integrally with the fourth gear 84 is rotated in the same direction, with the rotating force being transmitted to a sixth gear 86 and a seventh gear 87. The sixth gear 86 is coupled at its rotating shaft to a take-up core driving shaft 74 which winds up the ink ribbon R upon rotation of the stepping motor 80. It should be noted that a rim 74A for actually driving the ribbon take-up core 24 is attached, with a predetermined friction, to the take-up core driving shaft 74. While in normal state of operation, the rim 74A is rotated following the rotation of the take-up core driving shaft 74 by the stepping motor 80, however it is adapted to slip against a rotation of the take-up core driving shaft 74 when the ribbon take-up core 24 becomes unable to rotate, for example, because the ribbon take-up core 24 has reached the terminating end of the ribbon R.

The rotation of the seventh gear 87 is transmitted to a ninth gear 89 which meshes with an eighth gear 88 formed concentrically and integrally with the seventh gear 87, so as to rotate the platen driving shaft 72. A rim 72A for fitting with the irregular inner peripheral surface of the platen 12 is provided at the lower portion of the platen driving shaft 72. Accordingly, when the stepping motor 80 is rotated and its rotation is transmitted to the fourth gear 84 by means of the one way clutch, the platen driving shaft 72 and the take-up core driving shaft 74 are rotated at the end, so as to transport in accordance with a printing operation the tape T nipped between the platen rubber 14 provided on the outer circumference of the platen 12 and the head body 65 of the printing head 60 and at the same time to continuously take up the ink ribbon R in synchronization with the transporting of tape T.

Projecting stripes 72B and 74B for engaging the engaging stripes formed on the inner peripheral surface of the hollows of the platen 12 and the ribbon take-up core 24 are formed at equal distances, with three stripes formed on each outer peripheral of the shafts of the platen driving shaft 72 and the take-up core driving shaft 74. By driving the platen driving shaft 72 and the take-up core driving shaft 74 at a predetermined rotating speed with the stepping motor 80, the tape T and ink ribbon R are drawn out from the tape core 20 and ink ribbon core 22 by a predetermined amount so as to be laid upon each other and are passed between the platen rubber 14 and the printing head 60. When the tape T and the ink ribbon R are thus positioned, electricity can be conducted through the printing head 60 to control the heating value of each dot on the printing head, and ink from the ink ribbon R may be thermally transferred to the tape T to effect the printing of characters onto the tape T. After the printing has been completed, the appropriate portion of the tape T is discharged from the tape cartridge 10 and the ink ribbon R used for the printing is wound up around the ribbon take-up core 24 to be recovered.

When the tape T is transported in this manner during the printing process, the tape T is discharged from the tape outlet 10A on the left side of the body. While such discharged tape T should be severed by a cutting mechanism which will be described later, the user in some cases may try to draw out the tape T before the severance. However, if an attempt is made to forcibly draw the tape T out when the system is in a state which allows printing, this leads to a rotation of the platen driving shaft 72. Since the platen driving shaft 72 is largely geared down and since the stepping motor 80 possesses some degree of retaining torque, the platen driving shaft 72 cannot be rotated by the mechanism for normal operation when it is being forcibly rotated by withdrawal of the printing tape. In such a situation, the take-up core driving mechanism 74 cannot rotate properly either. Therefore, when the tape T is forcibly drawn out, the ink ribbon R is necessarily drawn out with the tape T. If the tape T is then severed by the cutting mechanism, the ink ribbon R will be also cut. This situation must be avoided.

The present embodiment overcomes the above-described problem by the use of a one-way clutch which is composed of the clutch arm 80B and the second through fourth gears, 82, 83 and 84. An attempt to extract the tape T causes the platen drive shaft 72 to rotate together with the platen 12. The rotation of the platen drive shaft 72 is transmitted to the fourth gear 84 through the gear train, so that the fourth gear 84 rotates counterclockwise. This also tends to rotate the third gear 83. However, since the shaft 80A of the stepping motor 80 does not rotate, the torque of the fourth gear 84 serves to push the clutch arm 80B carrying the third gear 83, thereby dismissing engagement between the third gear 83 and the fourth gear 84. As a consequence, the portion of the power train starting from the fourth gear and ending at the ninth gear 89 is disconnected from the stepping motor 80, so that the take-up core drive shaft 74 rotates as a result of rotation of the platen drive shaft 72 caused by the extraction of the tape T. Therefore, the ink ribbon R is taken up in accordance with the extraction of the tape T without being extracted together with the tape T. It is to be understood that the driving of the stepping motor 80 causes the clutch arm 80B to be shifted to the same side as the fourth gear 4, whereby the third gear 83 is brought into engagement with the fourth gear 84. This movement of the clutch arm 80B is limited by the opening 80C which is provided in the base 61 and which receives the end of the clutch arm 80B.

The tape T is discharged leftward from the tape cartridge 10 in accordance with the described printing operation. The tape discharged after the printing is performed can easily be severed by a severing mechanism of the type shown in FIG. 15. As shown in FIG. 15, a substantially L-shaped rotating tape cutter 90 and a spring (not shown) are fitted on a cutter support shaft projecting from the bottom of the cartridge mounting portion 50A. The resiliency of the spring produces a rotational biasing force which acts to bias the tape cutter 90 clockwise as indicated by a solid-line arrow D in FIG. 15, thereby holding the tape cutter 90 in the illustrated position. As a result of application of this rotational biasing force, the right end 90A of the cutter as viewed in the FIG. 15 contacts the reverse side of a cutter button 96 so as to push it upward. The right end 90A of the tape cutter 90 is bifurcated so as to define a valley which receives a pin 96A provided on the reverse side of the cutter button 96. Therefore, as the cutter button 96 is pressed downward, the left end 90B of the tape cutter 90 is moved downward.

A movable blade 98 for cutting the tape T is provided on the left end portion 90B of the tape cutter 90. The movable blade 98 is set at a predetermined angle from a stationary blade 91 which is provided on a side face of a cartridge mounting portion 50A. Therefore, the pressing of the cutter button 96 causes the tape cutter 90 to rotate clockwise as viewed in the figure against the force of the spring, whereby the tape T is cut by cooperation between the movable blade 98 and the stationary blade 91. A tape pressing member (not shown) is linked to the cutter button 96 such that the pressing member moves in accordance with the operation of the cutter button 96 so as to fix the printing tape T prior the cutting of the tape T. This movement of the tape pressing member is detected by a detecting switch 99 (not shown) which generates a detection signal which is used to prohibit printing when the tape T is being cut.

Figure 17:
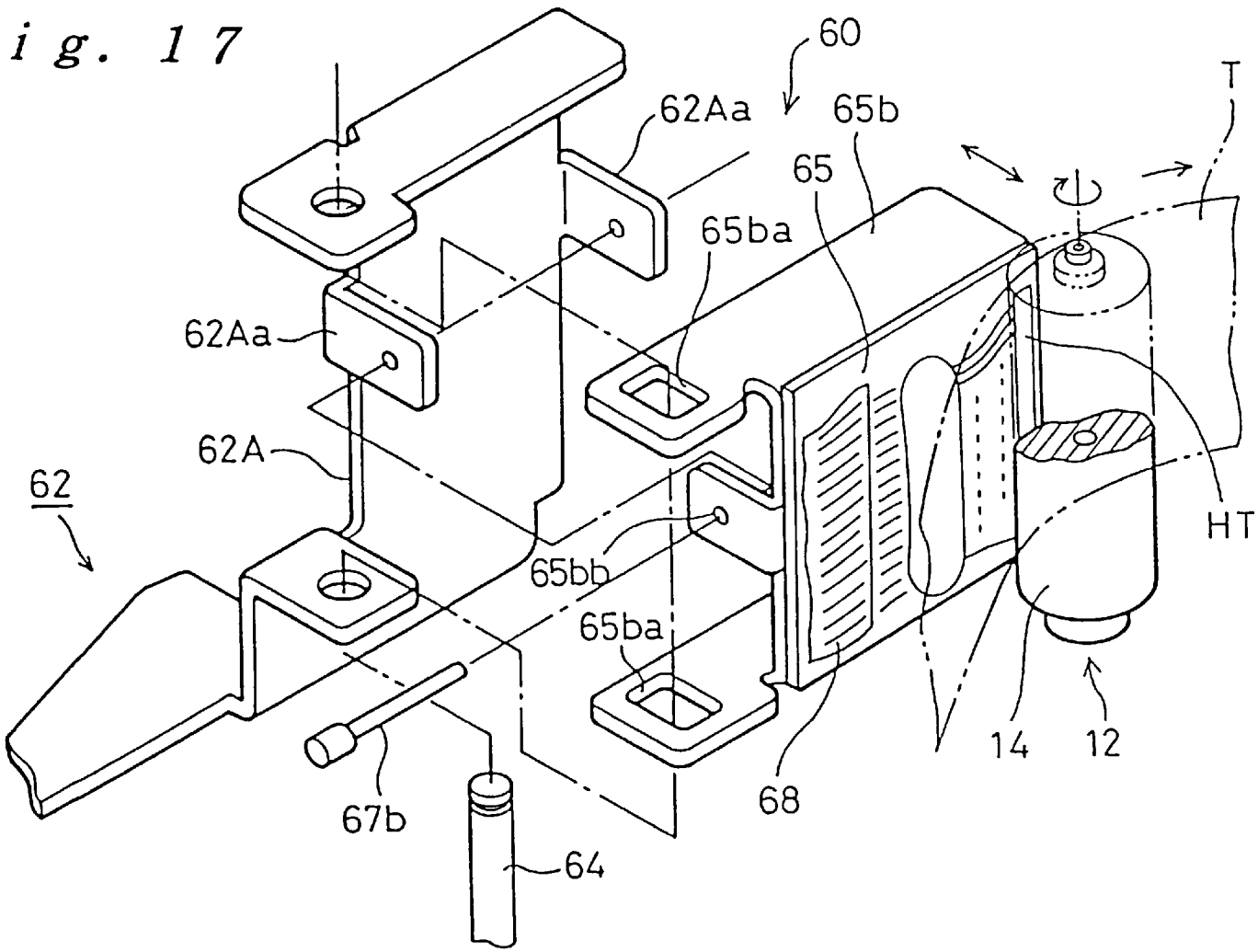
FIG. 17 is an exploded perspective view of the printing head 60.

A description will now be given of an operation in which a print head 60 for performing printing on the tape T is moved between a printing position where it is adjacent to the platen drive shaft 72 and a retracted position where it is moved away from the platen drive shaft 72 so as to allow mounting and dismounting of the tape cartridge 10 from the tape cartridge mounting portion 50A. As can be seen in FIG. 16 and FIG. 17, the printing head 60 has a head body 65 which is attached through a heat radiating plate 65*b* to an upright portion 62A of a rotary frame 62 which is journaled by a head rotary shaft 64 standing up from the baseboard 61. The rotary frame 62 indicated by a broken line in FIG. 16 is strongly pulled by a spring (not shown) in the direction indicated by a broken-line arrow E and abuts a cam member 63A so as to be firmly held by the cam member. While the rotary frame 62 is firmly held in this state, the upright portion 62A of the rotary frame 62 which is rotatable about the axis of the head rotary shaft 64 is positioned closest to the platen drive shaft 72 so that printing on the tape T can be executed by the print head 60 which is secured to the upright portion 62A.

A rotary shaft 64A*a* carrying the cam member 63A is connected to the lower end of a lever rotary shaft 63B which extends through a cylindrical member 50A*a* protruding from the cartridge mounting portion 50A as shown in FIG. 15. A head shifting lever 63C is provided on an upper part of the lever rotary shaft 63B integrally therewith. Therefore, as the head lever 63C is rotated 90° counterclockwise as indicated by the broken line F, the cam member 63A shown in FIG. 16 also is rotated 90° counterclockwise as indicated by the arrow C in FIG. 16. As a result, a recess 63A*b* of the cam member 63A and a projection 62B of the rotary frame 62 are made to engage with each other, thereby being stabilized. In this state. the upright portion 62A of the rotary frame 62 is positioned farthest from the platen drive shaft 72 so that the print head 60 which is secured to the upright portion of the rotary frame 62A is held at the retracted position so as to allow mounting and dismounting of the tape cartridge 10.

FIG. 17 is an exploded perspective view of the print head 60 which may be moved between the print position and the retracted position as described above, with the perspective view illustrating the details of the construction of the print head 60. It is to be understood that FIG. 17 presents a view which is opposite to that which is presented in FIGS. 15 and 16. As shown in FIG. 17, the printing head 60 has a head body 65 which is attached through a heat radiating plate 65*b* to an upright portion 62A of a rotary frame 62 journaled by a head rotary shaft 64 standing up from the base board 61. The head body 65 has a plurality of heat generating elements HT which produce heat at a large rate, and it is therefore attached to the heat radiating plate 65*b*. Since the head body 65 is carried by the rotary frame 62 so as to allow the printing head to rotate, electrical connection to the head body 65 is achieved through a flexible cable 68.

The heat radiating plate 65*b* is supported by the upright portion 62A of the rotary frame 62 at two points. One of the supporting points is the head rotary shaft 64 which extends through a pair of angular holes 65*ba* formed in the heat radiating plate 65*b*. Each angular hole 65*ba* has a longer axis and a shorter axis, and is formed such that the direction of the shorter axis coincides with the direction of conveyance of the printing tape. The length of the shorter axis is substantially equal to the diameter of the head of the head rotary shaft 64, while the length of the longer axis is about twice the length of the head of the head rotary shaft 64. The other supporting point is provided by a pin 67*b* which is received in a rotary bearing 62A*a* of the rotary frame 62 and in a rotary bearing 65*bb* of the heat radiating plate 65*b* so as to extend in a direction perpendicular to the head rotary shaft 64. Consequently, the heat radiating plate 65*b* is positioned so as to coincide with the direction of tape conveyance and is held rotatable in the direction of the width of the tape T about the longer axes of the angular holes 65*ba* and the pin 67*b*. Therefore, when the print head 60 is pushed towards the platen 12, the head body 65 is precisely located at a printing position where it directly faces the platen 12. When the tape T is sandwiched between the platen rubber 14 and the head body 65 with the head body 65 inclined in the direction of the width of the tape T, the heat generating elements HT can uniformly press the tape T against the platen 12, as the head body 65 is rotatable about the pin 67*b*, allowing the head body to achieve an inclination which will yield the most optimum conditions for printing. The thickness and the hardness of the platen rubber 14 on the platen 12 is determined to correspond to the hardness, thickness and the width of the tape T, so that the tape T can be pressed with a substantially uniform pressure distribution regardless of its hardness, thickness and width.

Figure 18:
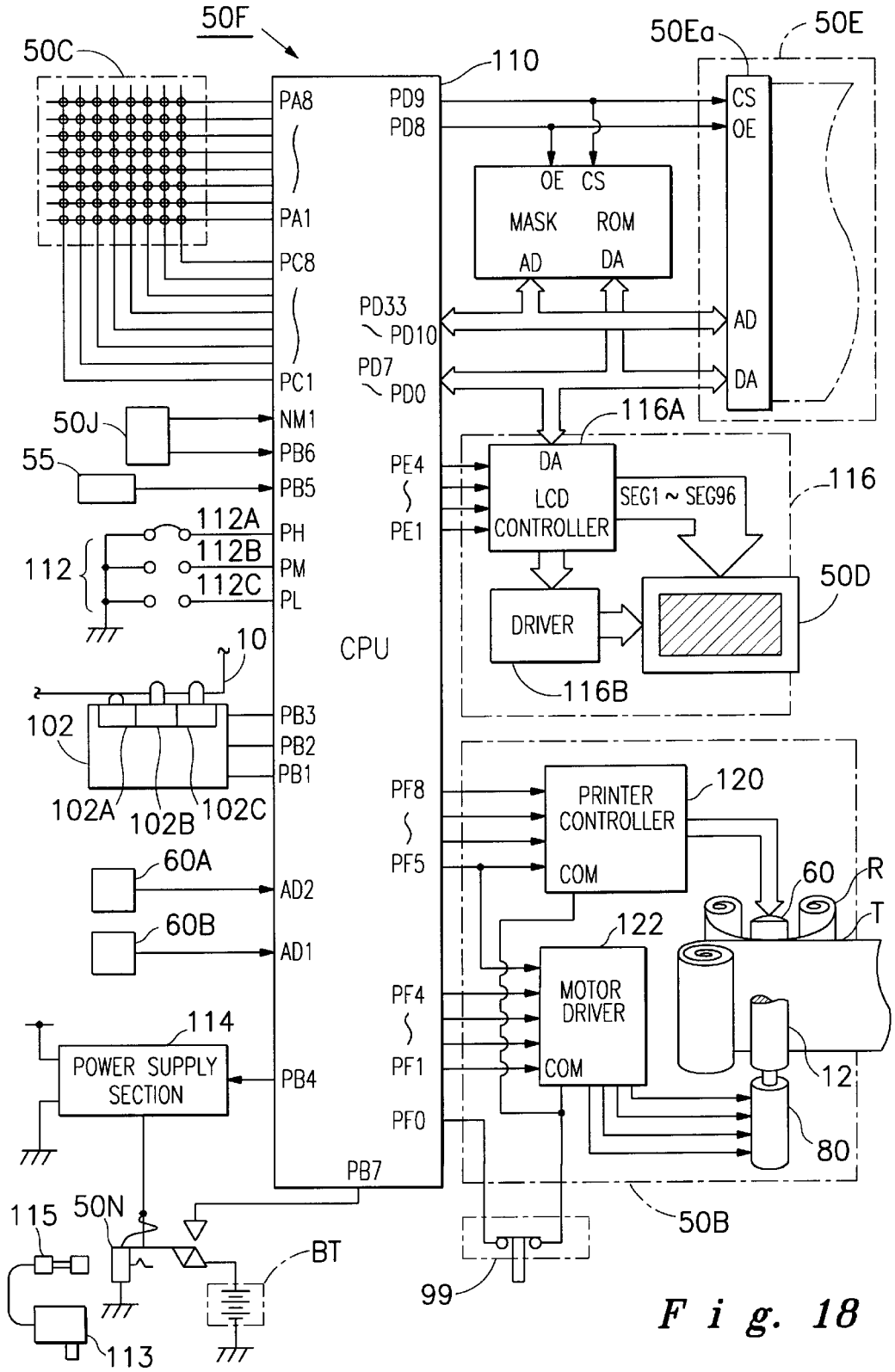
FIG. 18 is a block diagram of a structure controlled by a CPU 110.

A description will now be given which details the input section 50*c*, display section 50D and the printer section 50B which are incorporated in the tape writer 1. In order to facilitate understanding of the entire construction, a brief explanation will be given first of the electrical configuration including the control circuit section 50F and other electrical parts. The control circuit section 50F which is built up on a printed board is incorporated below a main part cover 50K, together with the printer section 50B and other portions of the electrical configuration. The overall electrical arrangement is shown in FIG. 18. The control circuit section 50F of the tape writer includes a single-chip microcomputer integrally incorporating ROM, RAM and an I/O (input/output) port, as well as a mask ROM 118. The control circuit section 50F also includes various circuits which provide interfaces through which the CPU 110 is connected to various sections such as the input section 50C, display section 50D and printer section 50B. The CPU 110 is connected to the input section 50C, display section 50D and other sections of the electrical configuration directly or via the interface circuits, so as to control these sections.

Figure 19:
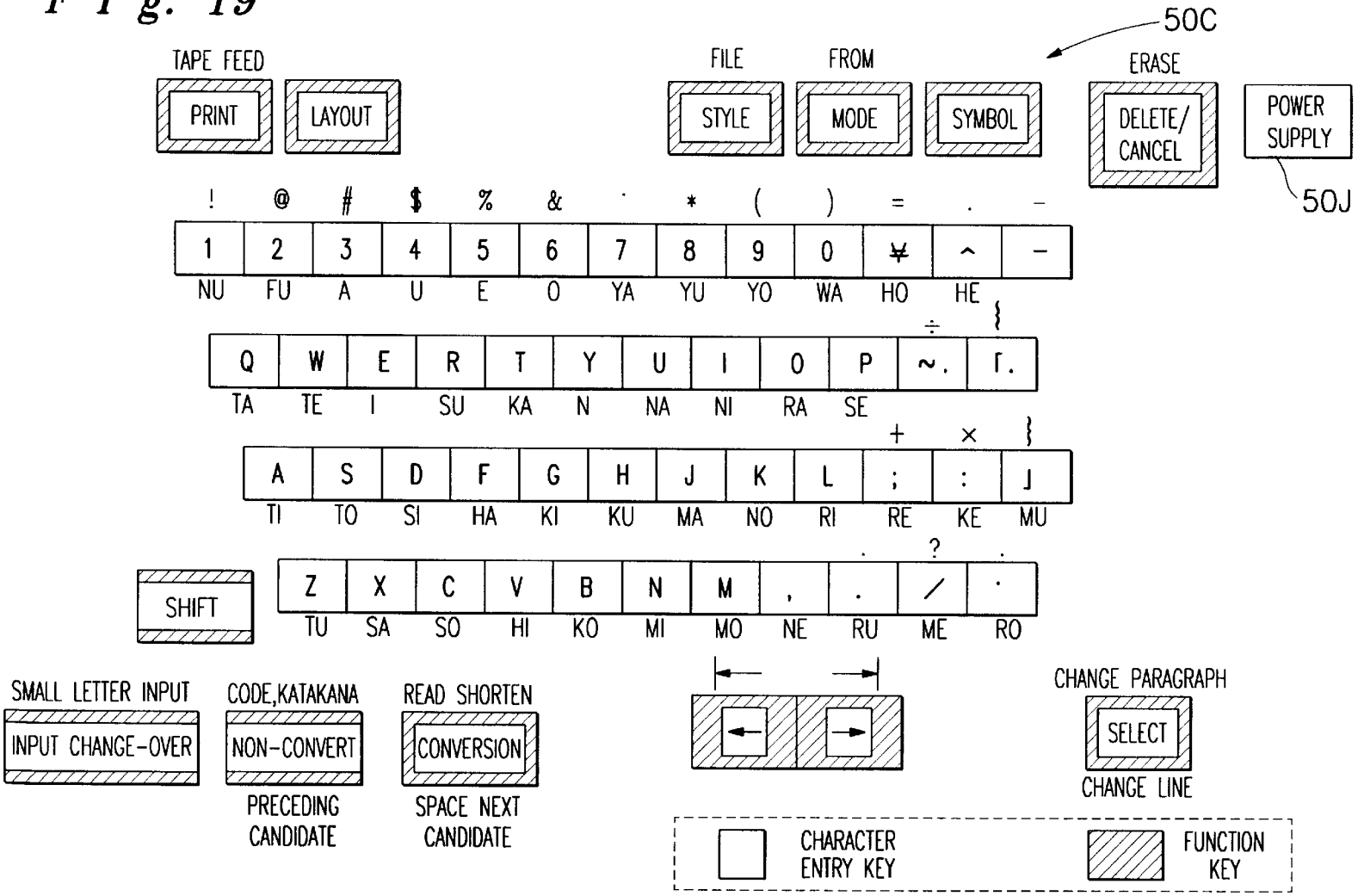
FIG. 19 illustrates a key array of an input section 50C.

As can be seen from FIG. 19, the input section 50C has 48 character input keys and 13 function keys. The character input keys are arranged in accordance with the JIS (Japanese Industrial Standards) form, thus presenting a full key arrangement. This key arrangement also includes a shift key which is provided in order to avoid increase in the number of keys to be manipulated, as is the case with ordinary word processors. The function keys are provided to enable frequently used functions such as editing and printing to be executed with a single keystroke, thereby enhancing the functionality of the tape writer 1.

The keys of the input section are allocated to an 8× 8 matrix. From the perspective of the CPU 110, 16 input ports including the input ports PA1 to PA8 and PC1 to PC8 are grouped to provide for the input of data, and the 61 keys of the input section 50C are arranged on the points of intersection between these groups of input ports. FIG. 19 illustrates in detail the keys of the input section 50C. A power switch 50J is provided independently of the matrix keys and is connected to a non-maskable interrupt MM1 of the CPU 110. When the power switch 50J is operated, the CPU 110 starts a non-maskable interrupt so as to execute power on and power off processing.

A cover position detecting switch 55 detects the opening/closing motion of the main part cover 50K and delivers a detection output signal to the port PB5, so that the CPU 110 is capable of monitoring the state of the main part cover 50K through the use of interrupts. When an open state of the cover 50K is detected during operation of the print head 60, the main display portion 50D*a* indicates occurrence of an error, and turns the power supply to the printer section 50B off.

Ports PH, PM and PL of the CPU 110 are connected to a head rank discriminating portion 112. Considerable fluctuation is inevitable in the print head 60 due to errors incurred in the production process. The head 60 is therefore assigned a ranking according to the result of a measurement of the resistance value of the print head 60, and the three jumper portions 112A, 112B and 112C of the head rank portion are set in accordance with the results of this measurement. During operation, the CPU 110 reads the state of the head rank portion 112 and performs a correction of the driving time, i.e., heat generation, of the print head 60 in accordance with the result of the reading. This correction prevents any variation in the thickness or density of the print.

The printing performed by the printer section 50B employs a thermal transfer printing technique, so that the thickness and density of the print depends not only on the energizing time but also on other factors such as ambient air temperature, driving voltage, and so forth. Variations in such factors are detected by the temperature detecting circuit 60A and the voltage detecting circuit 60B. These circuits 60A and 60B are incorporated into the print head 60 and their outputs are connected to 2-channel analog-to-digital conversion input ports AD1 and AD2 of the CPU 110. The CPU 110 can therefore read digital signals corresponding to the voltages appearing at the ports AD1 and AD2, thereby effecting correction of the length of time over which the print head is energized.

A discrimination switch 102 is connected to ports PB1, PB2 and PB3 of the CPU 110. As shown in FIG. 15, the discrimination switch 102 is disposed at the right lower corner of the cartridge mounting portion 50A. This discrimination switch 102 has three cartridge discrimination switches 102A, 102B and 102C which are received in the three detection holes 18K formed in the tape cartridge 10. The length of projection of the cartridge discrimination switches 102A, 102B and 102C is determined in relation to the depth of the detection holes 18K formed in the tape cartridge 10. Therefore, a discrimination switch 102 received by a detection hole 18K having a comparatively small depth will be stopped by the bottom of the hole 18K so as to be turned on, while a cartridge discrimination switch facing a comparatively deep detection hole 18K will be received fully in the detection hole without being stopped, so as to be kept off. Therefore, by detecting the states of the three cartridge discrimination switches 102A, 102B and 102C, it is possible to identify the type of the tape cartridge 10 mounted in the cartridge mounting section 50A and the width of the tape T in the tape cartridge 10. Information concerning the width of the tape T is used in the control of the size of the font to be printed, as well as in the control of the printer section 50B which will be described later.

A port PB7 of the CPU 110 receives a signal from a contact of a socket 50N which in turn receives a jack 115 so as to be supplied with D.C. power from an AC adapter 113. In this state, the supply of electrical power from the battery BT to the power supply portion 114 is interrupted due to an action of a break contact, thereby preventing wasteful use of the power from the battery BT. A signal from another contact in the socket 50N is received by the port PB7 of the CPU 110. The CPU 110 can therefore discriminate whether the main power of the tape writer 1 is derived from the AC adapter 13 or the battery BT, so as to employ different types of control according to the type of the main power supply. In this embodiment, when the power is being supplied from the AC adapter 113, the printer section 50B is operated at the highest printing speed, whereas, when the power is obtained from the battery BT, the speed of printing performed by the printer section 50B is lowered so as to suppress the peak of the electrical current supplied to the printing head 60, thus diminishing the consumption of power from the battery BT.

An 8-megabyte mask ROM 118 connected to the data bus stores three sets of characters of Mincho-type font, i.e., Japanese Kana, Kanji and special characters, having sizes of 16×16, 24×24 and 32×32. A 24-bit address bus AD, a 8-bit data bus DA, a chip select signal CS and an output enable signal OE of the ROM 118 are connected to ports PD0 through PD33 of the CPU 110. These signals also are connected to an external I/O connector 50E*a*. Therefore, an extension section 50E mounted on the external I/O connector 50E*a* is accessible by the CPU.

The extension section 50E, which can be directly connected to the control circuit section 50F, provides a receptacle for a ROM pack or a RAM pack which can supplied as an optional external storage device. Insertion of such a ROM pack or RAM pack into the receptacle completes electrical connection of the control circuit section 50F to the external I/O connector section 50E*a*, thereby enabling exchange of information between the ROM or RAM pack and the control circuit section 50F. The extension section may receive any of several different ROM packs which can contain various kinds of characters such as those for drawings, maps, chemistry and mathematics, language fonts other than Japanese, as well as fonts such as Gothic, Mincho and so forth. Similarly, a writable RAM pack received in the extension section can store information in excess of that which can be held by the RAM area in the tape writer, thus enabling the formation of a library of a print character sequence or the exchange of data between different units of the tape writer 1.

The character dot data read from the mask ROM 108 or from the extension section 50E is input to an LCD controller 116A of the display control circuit 116, as well as to the CPU 110.

Figure 20:
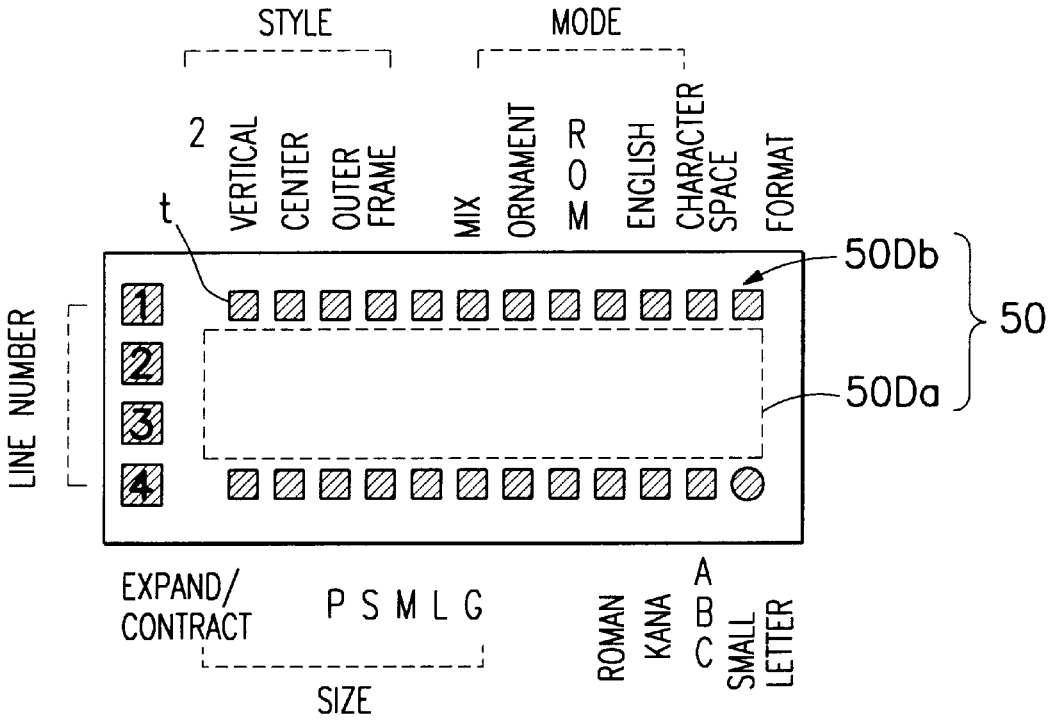
FIG. 20 illustrates a display section 50D.

The display section 50D controlled by the CPU 110 through the display control circuit 116 is disposed beneath a transparent portion of the main part cover 50K, so as to be observed by the user through the transparent portion. The display section 50D has two types of electrode patterns arranged on a liquid crystal panel. As shown in FIG. 20, one of these two types of electrode patterns is a dot matrix pattern, while the other includes 28 electrode patterns of square, circular and other forms arranged to surround the dot matrix region. The region in which the electrodes constituting the dot matrix pattern are arranged is referred to as a main display portion 50D*a* which displays character images, while the region where the square and circular electrode patterns are formed is referred to as an indicator portion 50D*b*.

The main display portion 50D*a* is a liquid crystal display panel capable of presenting a display which is 16 dots high and 96 dots wide. In this embodiment, character fonts of 16 dot wide and 16 dot high are used in the character entry and editing, so that the main display portion can display a single line having 6 characters. The display of characters may be done in various manners depending on the current status of processing. The characters may be displayed with positive display, negative display or flickering display, so as to visually inform the user of the state of processing in the tape writer 1.

Since the main display portion 50D*a* is a dot matrix display which enables free control of the content of the display, it is possible to display the instant print image when a key of the input section 50C as shown in FIG. 19 is pressed.

The printer section 50B of this tape writer 1 has mechanical components including the print head 60 and the stepping motor 80, and electrical components including a printer controller 120 and a motor driver 122 which control the mechanical components. The print head 60 is a thermal head having 64 heating points which are arrayed in a single vertical row at a pitch of 1/180 inch, and is provided with the aforesaid temperature detecting circuit 60A for detecting the ambient air temperature and the voltage detecting circuit 60B for detecting the supplied voltage. The stepping motor 80 has a reduction gear train which is designed such that when the tape thickness is 100 μm, the tape T is fed at 1/360 inch per one step of the stepping motor 80. The arrangement is such that a motor drive signal corresponding to two steps of the stepping motor is supplied to the stepping motor 80 per one dot of print performed by the print head 60. Thus, the printer section 50B performs printing not only in the direction of the tape width but also in the longitudinal direction of the tape T. The printing in the longitudinal direction is performed at a pitch of 180 dots/inch. When a tape of 200 μm thick is used, the thickness of the platen rubber 14 is changed, so that the amount of the tape T fed per one step of the stepping motor 80 is changed. More specifically, the amount of tape T fed per one step of the stepping motor 80 increases 2% when the outside diameter of the platen 12 is 9 mm. Therefore, no practical problem arises even when the tape feed rate is not controlled in accordance with the tape thickness.

The detection switch 99 mentioned previously is connected to a common line which interconnects the CPU 110 to the printer controller 120 and the motor driver 122. The detection switch 99, which is intended to detect the state of the severing mechanism, operates so as to immediately terminate the operation of the printer section 50B whenever it detects that the severing mechanism is going to start during printing. However, since the delivery of signals from the CPU 110 to the printer controller 120 and the motor driver 122 is not interrupted, the printing is restarted when the operation of the severing mechanism is completed.

The tape writer 1 also includes a power supply portion 114 which provides a stable 5 volt power source for backup and for logic circuits from the battery BT, by an RCC system which makes use of an IC and a transformer. A port PB4 of the CPU 110 is used for the purpose of controlling the voltage from the power supply portion 114.

The internal ROM of the CPU 110 controlling the above-described peripheral circuits stores various programs for executing the above-described operations. The internal RAM of the CPU 110 has a portion which serves as a system preservation area to be used for the purpose of execution of the programs stored in the internal ROM. Other portions of the internal RAM are available to the user for use as a file area and for editing work.

Figure 21:
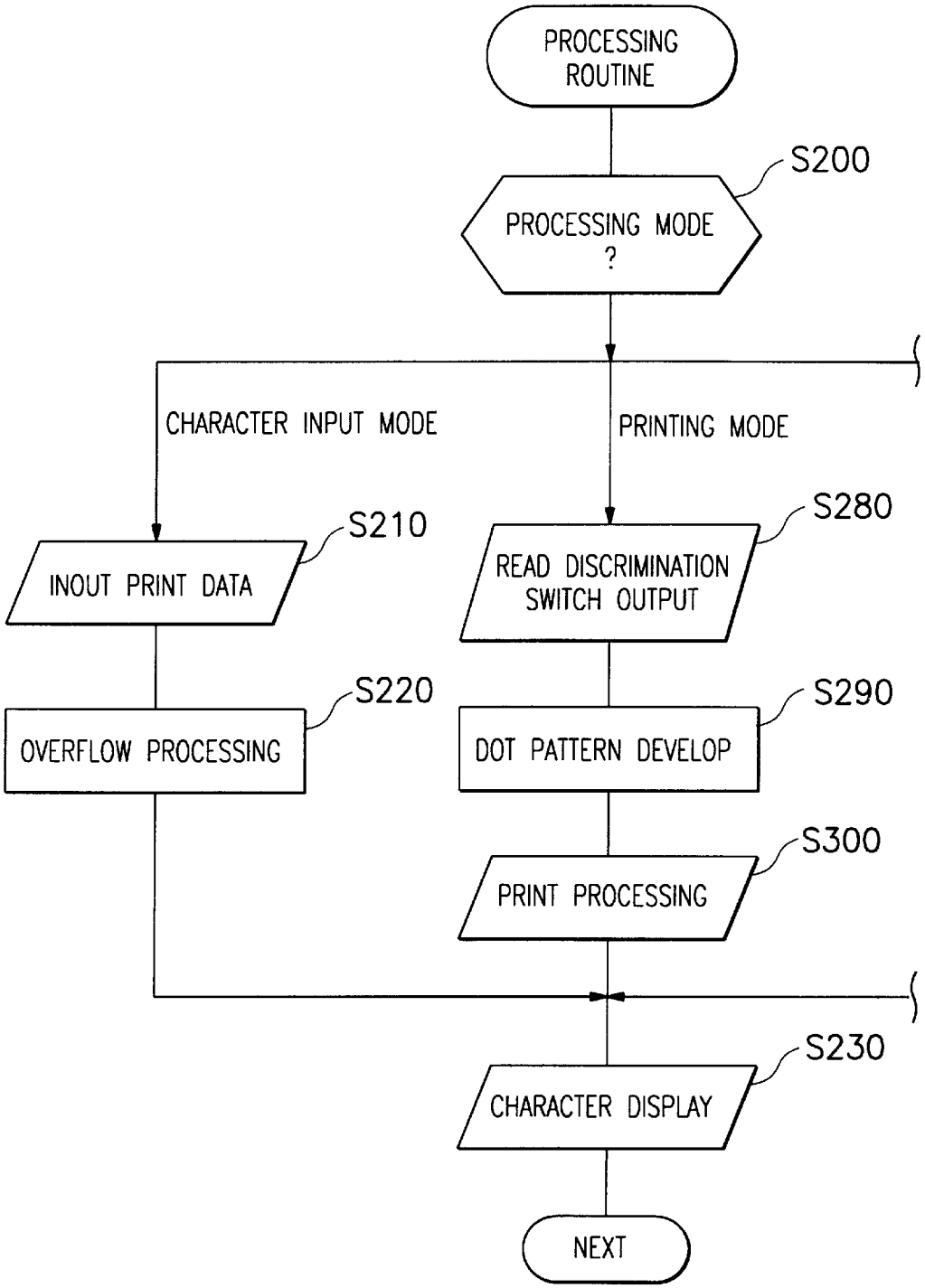
FIG. 21 is a flowchart showing an outline of the processing performed by the tape writer 1.
Figure 22A:
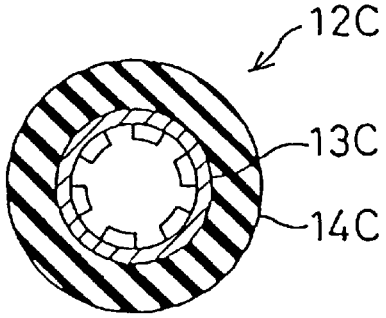
FIGS. 22(*a*), 22(*b*), 22(*c*) and 22(*d*) illustrate adjustment of the overall hardness of the platen 12 by adjusting both an outer diameter of the shaft 13 and a thickness of the platen rubber 14.
Figure 22C:
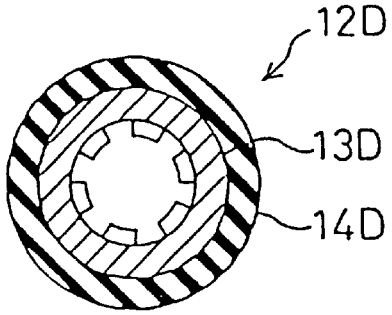
Figure 22B:
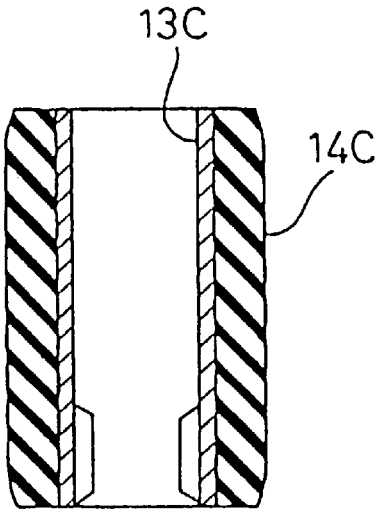
Figure 22D:
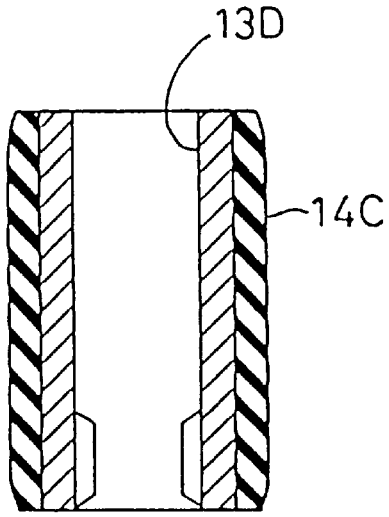

A brief explanation will now be given of the overall process performed by the tape writer 1 in accordance with this embodiment. FIG. 21 is a flow chart showing a portion of the processing routine to be performed by the tape writer 1. The tape writer 1 has various operation modes. Pressing of specific function keys in the input section 50C triggers various modes such as a line number appointing mode, layout display mode and so forth, as will be described later. When keys corresponding to characters are pressed while there is no designation of a mode, character data to be printed is entered.

As the processing routine is started, the identification of the processing mode is performed in Step S200. If no mode has been designated, the CPU determines that the present mode is the character input mode, so that entry of the print data is executed in Step S210. Entry of the character data for alphanumeric characters is implemented by directly delivering the character data input from the keys to a print data buffer. Entry of Japanese Kana and Kanji is done by delivering Kana characters input from the input section 50C to the print data buffer after Kana/Kanji conversion.

The print data buffer has a capacity large enough to store a maximum of 125 characters, so that overflow processing is conducted in Step S220 when character input data has exceeded this capacity. More specifically, in cases where input data has been added to a character sequence, the overflow processing operation cuts any portion of the character sequence beyond 125 characters once the character sequence to be finally entered has been determined through the Kana/Kanji conversion. The overflow processing also deletes characters beyond 125 characters when input data is inserted to an intermediate portion of the sequence with the result being that the maximum number of characters is exceeded. After overflow processing is performed, a process is executed to display the finally determined character sequence on the display section 50D, in Step S230.

A routine (not shown) is conducted as a part of the character displaying processing (S230), in which, by making use of the print data in the print data buffer, the indicating elements "t" of the "line number" in the indicator portion 50D*b* corresponding to the number of lines of the print data are lit on, and at the same time, the indicator element "t" corresponding to the line where the cursor is located, is made to flicker. Then, the print data on the line under the edited work is displayed by the dot matrix of the main display portion 50D*a*.

As a result of this processing, the user can acquire information such as the total number of lines of print data being edited as well as the line on which the cursor is located by observing the "line number" displayed in the indicator portion 50D*b*. After completing this display processing in Step S230, the process proceeds to "NEXT", thus completing the main processing routine.

A description will now be given of the printing mode. When the printing mode is designated, Step S280 is executed in which the detection signal from the cartridge discrimination switch 102 is read, followed by execution of Step S290 in which the width of the tape T of the currently mounted cartridge is determined based on the detection of the cartridge discrimination switch 102 and in which the dot pattern of each line is developed by referencing a font map stored in the internal ROM. The dot pattern which is developed is based on the detected tape width and the size of each character sequence.

When the print font to be used in the printing of each line is determined, print fonts corresponding to the appropriate character codes of the character sequence to be printed are successively read from the mask ROM 118 and are developed into dot patterns to be printed. This operation is referred to as dot pattern developing processing (Step S290). After the development of the dot pattern, the process proceeds to Step S300 which performs the print processing. In this process, the developed dot patterns are cut into vertical dot lines so as to form 64-bit serial data which is transferred to the printer section.

The basic modes of use and operation of the tape writer 1 of this embodiment have been described. The tape writer 1 also has various other modes of use, although a description of such modes is omitted.

As will be understood from the foregoing description, the tape cartridge 10 of the illustrated embodiment offers the following remarkable advantage in that, by virtue of the use of the platen rubber 14 having a width and hardness which is determined in relation to the hardness, thickness and width of the tape T accommodated in the tape cartridge, it is possible to obtain high print quality without incorporating an adjusting mechanism which would compensate for variations in printing tapes. More specifically, in each tape cartridge, the platen rubber 14 has a hardness which is determined in relation to the hardness of the tape T in the same cartridge, so that the tape T and the ink ribbon R can be nipped between the platen 12 and the printing head 60 with a moderate pressure suitable for the printing, regardless of the hardness of the tape T. When the platen rubber 14 has a thickness and hardness which are determined in relation to the thickness of the tape T in the same cartridge, the tape T can be fed reliably by the functioning of the platen 12 and the tape guide pin 26, and the tape T can be nipped together with the ink ribbon R between the platen 12 and the printing head 60 with a moderate pressure suitable for the printing, regardless of the thickness of the tape T. When the platen rubber 14 has width and hardness which are determined in relation to the width of the tape T in the same cartridge, printing over the entire area of the tape T is made possible and the tape T can be nipped together with the ink ribbon R between the platen 12 and the printing head 60 with a moderate pressure suitable for the printing.

It is therefore not necessary for the tape writer 1 to incorporate any means of compensation for variation in the hardness and thickness of the tape T. Furthermore, the user is relieved from the burdens of adjusting tape cartridges to accommodate different tape types and of adjusting the tape writer 1 to adapt it to different types of tapes.

When the surface roughness of the platen rubber 14 is selected to correspond to the roughness of the release tape of the tape T, the release tape can be held in a state of optimal contact with the paten 12, so as to ensure safe feeding of the tape T. When the platen rubber roughness is thus selected, the adhesion of the release tape to the platen rubber 14 is avoided even when the tape cartridge 10 has been mounted in the tape writer 1 for a long time. Furthermore, since the platen rubber 14 has a barrel-like shape, any tendency of the tape T or the ribbon R to move towards the top wall 16 or the bottom wall 18 is suppressed, thereby eliminating print quality problems which result from such movement.

Furthermore, the position of balance between the printing head 60 and the platen 12 is fixed so as to ensure that the tape T is fed at a constant rate. This position of balance is maintained due to the selection of a platen rubber 14 which has a hardness determined in relation to the width of the ink ribbon R.

The described embodiment therefore enables use of different types of tape T without requiring modification or adjustment to the tape writer 1. This is avoided by virtue of the fact that the width and hardness of the platen rubber are determined to correspond to the particular combination of hardness, thickness and width of the tape T, as well as the width of the ink ribbon R. This provides for a wider selection of tapes T, thereby promoting development of new types of tape cartridge.

In the illustrated embodiments, the platen rubber 14 is barrel-shaped, so that the tape T and the ink ribbon R can be fed while remaining centered at the central portion 14*b* of the platen rubber 14. Problems resulting from the deviation of the tape ribbon T or the ink ribbon R to one end of the platen rubber are therefore avoided, and the printing can be performed under ideal conditions. The barrel shape of the platen rubber 14 also offers an advantage over the case where the central portion 14*b* of the platen rubber 14 has an outside diameter equal to that of both end portions 14*a* of the platen rubber, in that a platen rubber manufactured according to such a design may end up having a central portion 14*b* that in fact has a smaller outer diameter than that of the end portions, due to slight tolerancing deviations in the manufactured product. It is likely that this problem would continue to some extent even if the fabrication tolerances were increased. A design which provides for a central portion of the platen rubber that has larger outer diameter than the ends avoids this tolerancing problem and therefore offers increased yield of the platen rubber 14.

Since the width of the tape T accommodated in the tape cartridge 10 affects the three detection holes 18K*a*, 18K*b* and 18K*c* formed in the bottom wall 18, the tape writer 1 can automatically recognize the width of the tape in the tape cartridge 10, based on the 3-bit information derived from the discrimination switch 102. cst In the illustrated embodiments, the reduction gear train of the tape writer 1 is designed so as to provide a tape feed rate of 1/360 inch per one step of the stepping motor 80 when the tape thickness is 100 μm, with a 2% variation in the feed rate for the greater tape thickness of 200 μm. However, this is only illustrative and an arrangement can also be used in which part of the reduction gear train is mounted on the tape cartridge with such part of the reduction gear train being designed specifically for each type of tape cartridge so that the above-mentioned tape feed rate of 1/360 inch can be obtained without variation on all types of the tape cartridges. With this arrangement, it is possible for a tape writer which does not have any mechanism for effecting compensation for tape thickness variations to perform printing without variation in the tape feed rate, regardless of differences in the thickness of the tape T.

In the present embodiment, the hardness of the platen rubber 14 is varied in relation to the hardness, thickness and width of the tape T to provide the described advantages. The same advantages can also be obtained when the hardness of the whole platen is varied, through suitable selection of the outside diameter of the platen shaft 13 and the thickness of the platen rubber 14, as opposed to varying the thickness of the platen rubber 14 alone. FIGS. 22(*a*) and 22(*b*) show a platen 12C having a shaft 13C of a comparatively small outside diameter and a platen rubber 14C of a comparatively large thickness, as viewed in a section taken along a plane perpendicular to the axis and in a section taken along the axis. Similarly, FIGS. 22(*c*) and 22(*d*) show a platen 12D having a shaft 13D of a comparatively large outside diameter and a platen rubber 14D of a comparatively small thickness, as viewed in a section taken along a plane perpendicular to the axis and in a section taken along the axis.

As shown in FIG. 22, the platen 12C is composed mainly of the shaft 13C of a comparatively small outside diameter and a platen rubber 14C of a comparatively large thickness and provided on the shaft 13C, while the platen 12D is composed mainly of the shaft 13D of a comparatively large outside diameter and a platen rubber 14D of a comparatively small thickness and provided on the shaft 13D. The outside diameter of the platen rubber 13C of the platen 12C and the outside diameter of the platen rubber 13D of the platen 12D are equal to each other, and are made of the same hardness of silicon rubber. Elastic materials such as a rubber exhibit characteristics which follow Hooke's law (F=kx). The elasticity constant k is proportional to the area of a cross-section perpendicular to the direction in which a force acts on the elastic member and is inversely proportional to the length of the elastic member as measured in the direction of action of the force. Therefore, when both the platen 12C and the platen 12D are subjected to the same level of pressure exerted by the printing head 60, the platen 12C exhibits a greater deformation that the platen 12D. That is, the whole platen structure 12C is softer than the whole platen structure 12D. It is therefore possible to obtain a platen having the desired level of hardness without changing the outside diameter of the platen by changing both the outside diameter of the shaft 13 and the thickness of the platen rubber 14. By matching these platens to appropriate combinations of hardness, thickness and width of the tapes T, it is possible to achieve the same benefits as those obtained in the foregoing description in which platen rubbers 14 of different levels of hardness are used.

The described arrangement in which the overall hardness of the platen 12 is adjusted by selection of the outside diameter of the platen shaft 13 and the thickness of the platen rubber 14 offers an advantage in that the platen rubbers 14 of different platens can be produced from the same material, thus eliminating the laborious work which otherwise would be required to adjust the composition of the rubber material to develop different levels of hardness of the rubber itself. For the same reason, it is possible to reduce undesirable variation in the hardness among the formed platen rubbers 14.

Figure 23A:
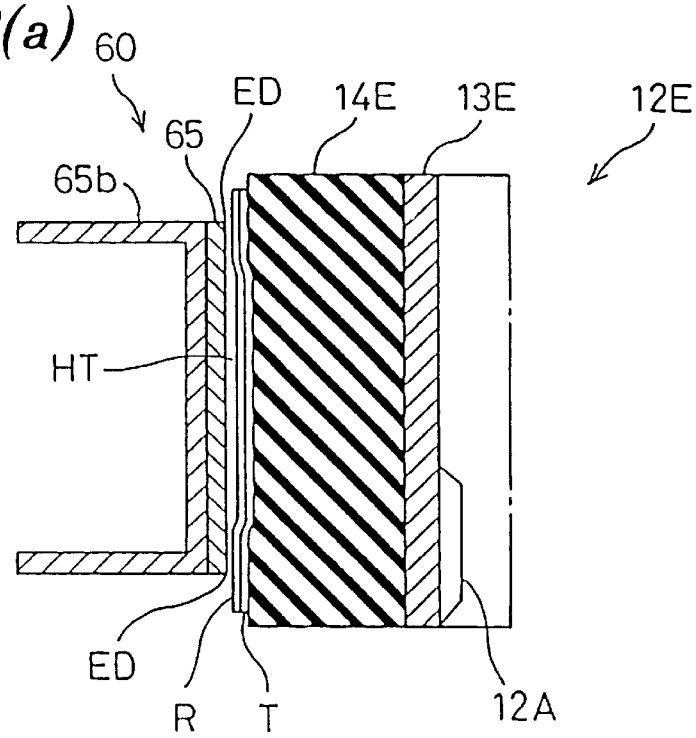
FIGS. 23(*a*) and 23(*b*) are cross-sectional views illustrating a state wherein the tape T and the ink ribbon R are held by the platen rubbers 14E and 14F having a hardness of 90 degrees and 40 degrees, respectively, and the printing head 60.
Figure 23B:
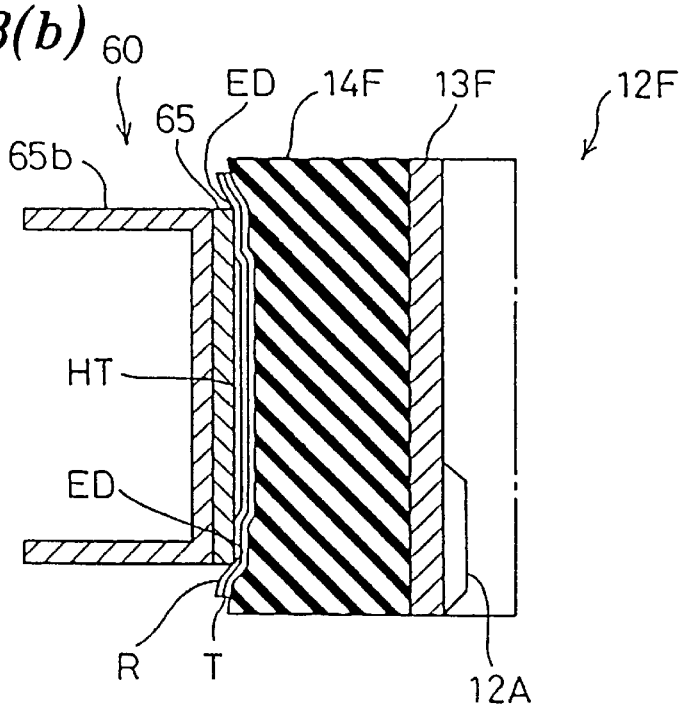

In the present embodiment, the hardness of the platen rubber 14 is selected to correspond to the hardness, thickness and width of the tape T. However, the properties of the tape T do not exclusively determine the hardness of the platen rubber 14. The arrangement may be such that the hardness of the platen rubber 14 is determined to correspond to the nature of the ink ribbon R. For instance, when the ink ribbon R uses a wax-type ink, there is a risk that the ink will become molten when strongly pressed. If this molten ink is transferred to the tape, the print quality will be adversely affected. In such a situation, a platen rubber having a high degree of hardness is used regardless of the hardness, thickness and width of the tape T, in order to obtain high print quality. FIG. 23(*a*) illustrates, in a sectional view, an arrangement in which a tape T and an ink ribbon R are nipped between a printing head 60 and a platen 12E with a platen rubber 14E having a thickness of 90 degrees. The hardness of the platen rubber is 90 degrees regardless of the hardness, thickness and width of the tape T. FIG. 23(*b*) shows, in the same section as that of FIG. 23(*b*), a printing head 60 and a platen 12F with a platen rubber 14F whose hardness has been selected at 40 degrees to correspond to the hardness, thickness and the width of the tape T.

Referring first to FIG. 23(*a*), the platen rubber 14E is deformed by the pressure of the printing head 60, however the platen rubber 14E is not deformed to a large extent as it is fabricated with a hardness as high as 90 degrees. Therefore, the platen rubber 14E serves merely to press the tape T and the ink ribbon R to the heat generating elements HT. Referring now to FIG. 23(*b*), the platen rubber 14F having comparatively low level of hardness is deformed to a large extent such that the tape T and the ink ribbon R are pressed strongly against the edges ED at the upper and lower ends of the head body 65 as viewed in the figure, with the result being that the tape T is contaminated with the ink from the ink ribbon R. Thus, the arrangement shown in FIG. 23(*a*) can prevent contamination of the tape T even when the ink ribbon R uses an ink of a type which exhibits a large tendency of deposition to the tape T.

Figure 24:
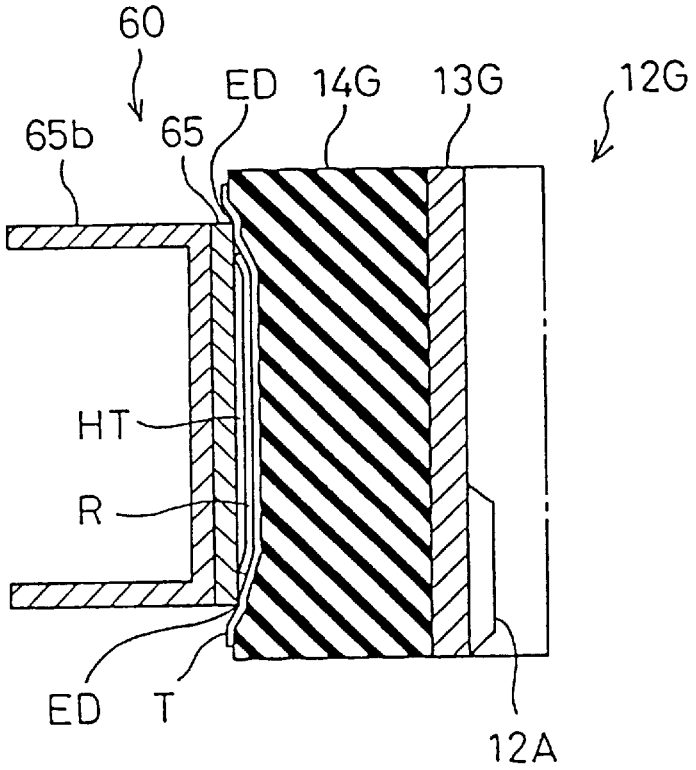
FIG. 24 is a cross-sectional view illustrating a state wherein the tape T and an ink ribbon R having a width greater than the width of a heating member HT and less than the width of a head body 65 are held by a platen 12G and the printing head 60.
Figure 25:
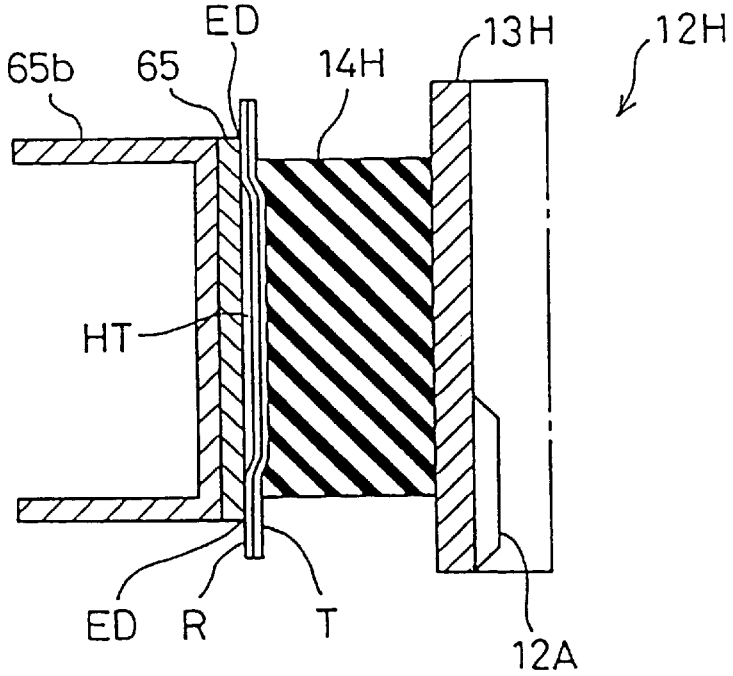
FIG. 25 is a cross-sectional view illustrating a state wherein the ink ribbon R and the tape T are held by a platen 12H having a width greater than the width of the heating member HT and less than the width of the head body 65 and the printing head 60.

The use of the hard platen rubber 14E to prevent contamination of the tape T due to pressing of the tape T and the ink ribbon R against the edges ED of the head body 65 is only illustrative, and various different measures can be taken to eliminate the problem of tape contamination. For instance, FIG. 24 shows an arrangement in which a width of ink ribbon R is employed which is not smaller than the width of the heat generating elements HT but not greater than the width of the head body 65, regardless of the width of the tape T. FIG. 25 shows another solution in which a width of platen rubber 14H is employed which is not smaller than the width of the heat generating elements HT but not greater than the width of the head body 65, regardless of the width of the tape T. When a width of ink ribbon R is employed which is not smaller than the width of the heat generating elements HT but not greater than the width of the head body 65 as shown in FIG. 24, the ink ribbon R together with the tape T is never pressed against the edges ED of the head body 65, even when the tape T is strongly pressed against the edges ED of the head body 65. In this situation, the ink ribbon R cannot contact the edges ED of the head body 65 because the width of the ink ribbon R is smaller than that of the head body. Similarly, in the arrangement shown in FIG. 25 in which a width of platen rubber 14H is employed which is not smaller than the width of the heat generating elements HT but not greater than the width of the head body 65, the problem of contamination of the tape T with the ink cannot occur because the tape T and the ink ribbon R are not pressed against the edges ED of the head body 65.

Figure 26:
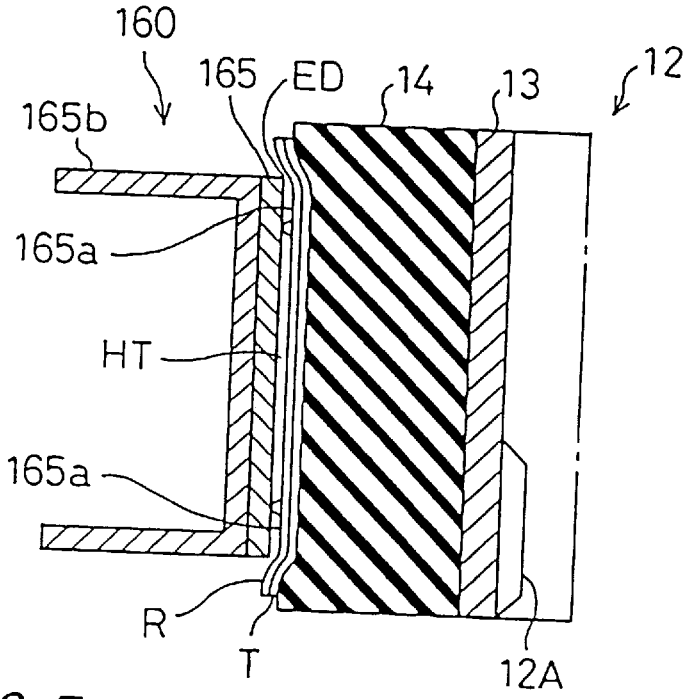
FIG. 26 is a cross-sectional view illustrating a state wherein the ink ribbon R and the tape T are held by a printing head 160 having members 165*a* provided at two end portions of a head body 165 and the platen 12.
Figure 27:
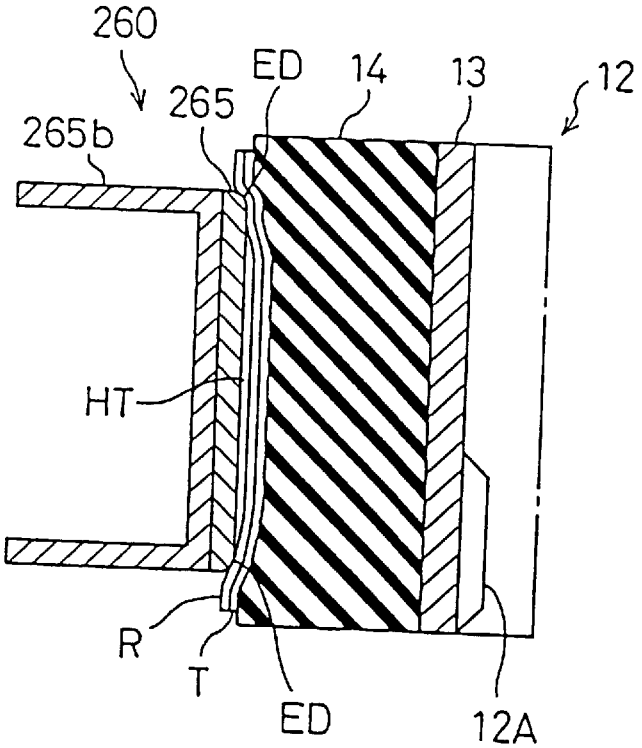
FIG. 27 is a cross-sectional view illustrating a state wherein the ink ribbon R and the tape T are held by a printing head 160 in which corners ED of two end portions of a head body 165 are machined and the platen 12.

The arrangements shown in FIGS. 26 and 27 also are effective in preventing the above-described problem of contamination of the tape T.

FIG. 26 shows an arrangement in which members 165*a* are provided on both end portions of the surface of the head body 165 of the printing head 160 facing the platen, so as to smooth the above-mentioned surface of the head body 165 which faces the platen. FIG. 27 shows an arrangement in which the edge portions ED of the head body 265 of the print head 260 are smoothly curved to achieve the same result.

The member 165*a* used in the arrangement shown in FIG. 26 may be of any suitable material such as a glassy material formed on the surface of the heat-generating elements HT. The member 165*a,* when formed of a glassy material, may be fabricated integrally with the heat-generating elements HT or may be made separately. The arrangements shown in FIGS. 26 and 27 reduce the load per unit area on the tape T and the ink ribbon R to a level that will not lead to the deposition of the ink from the ink ribbon R to the tape T, thus preventing the problem of contamination of the tape T.

In the previously described embodiment, a softer platen rubber 14 is used when a wider ink ribbon R is used. Since the objective is to fix the position of balance between the platen rubber 14 and the printing head 60, an arrangement also may be effectively employed in which the diameter of the platen 12 is selected to be smaller when a wider ink ribbon R is used. This can be implemented by reducing the thickness of the platen rubber 14 of the platen 12 when the wider ink ribbon R is used. In this case, the hardness of the platen rubber 14 is maintained at a constant value regardless of the width of the ink ribbon R. This arrangement allows the platen rubbers 14 of different platens 12 to be formed from the same material, thus eliminating the need to delicately adjust the rubber composition to realize the desired hardness level.

An arrangement also can be effectively used in which the hardness and the thickness of the platen rubber 14 are determined in relation to the width of the ink ribbon R. This arrangement is a combination of the arrangement in which the hardness of the platen rubber 14 is reduced when the ink ribbon width increases and the arrangement in which the outside diameter of the platen 12 is reduced in accordance with an increase in the width of the ink ribbon R. In other words, the two techniques, i.e., softening of the platen rubber and reduction in the platen diameter, may be used individually or in combination to achieve optimum printing conditions. The combined use of these two techniques provide a flexible means for adapting to the variation in the width of the ink ribbon R.

Figure 28:
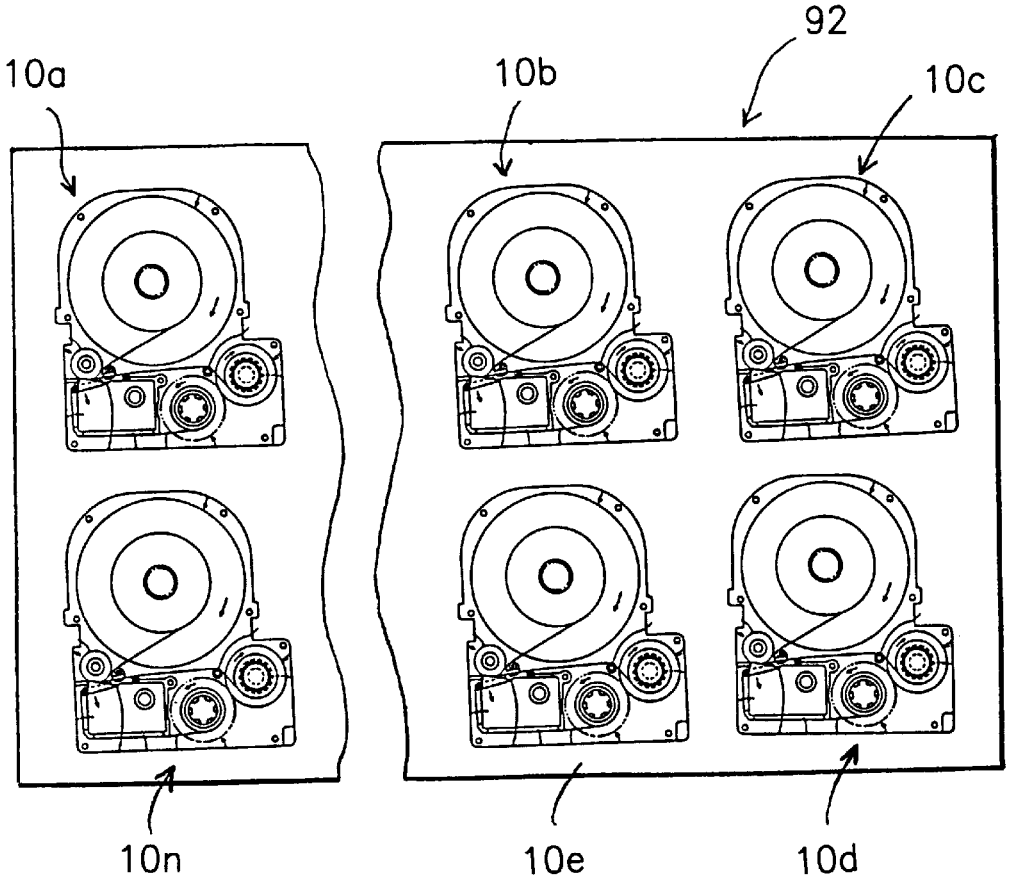
FIG. 28 is a depiction of a kit 92 containing at least two different tape cartridges.

FIG. 28 depicts a kit 92 of tape cartridges containing a plurality of different tape cartridges 10*a–n*. The kit 92 enables printing to be performed on a variety of different types of printing tape using a single printing apparatus. This is due to the fact that each tape cartridge provided in the kit is specifically designed to provide high quality printing using the particular printing tape and ink ribbon which are incorporated into the cartridge. The cartridges are individually adapted to the extent that a constant print head pressure may be used and any adjustment or modification to the printing apparatus or tape cartridge is unnecessary, thereby simplifying operation of the printing apparatus and tape cartridge.

Although different forms and embodiments of the present invention have been described, it is to be understood that these embodiments or forms are only illustrative and various changes and modifications may be imparted thereto without departing from the scope of the present invention. For instance, although in the foregoing description the tape T accommodated in the tape cartridge has an adhesive layer on its reverse side, various other types of tape can satisfactorily be used, such as a tape lined with an adhesive tape, a laminate type tape having a transparent sheet protecting the print surface, or a transfer type tape carrying a transferable ink for printing. It is also to be noted that the tape cartridge may not contain an ink ribbon, although the ink ribbons are accommodated in the ink cartridges of the described embodiments.

In the set of tape cartridges provided according to the first aspect of the present invention, the harder the printing tape, the softer the rubber provided on the surface of the platen. Accordingly, the pressed state of the printing tape as it is pressed against the platen by the printing head can be made uniform regardless of the hardness of the printing tape. Consequently, high quality printing can be obtained regardless of the hardness of the printing tape. As a result, it is not necessary for the user to adjust or otherwise operate complicated tape cartridges in order to accommodate printing tapes having different hardness. The adjustment of the printing apparatus is also unnecessary.

In the set of tape cartridges provided according to the second aspect of the present invention, the wider the printing tape, the softer the rubber provided on the surface of the platen. Accordingly, the pressed state of the printing tape as it is pressed against the platen by the printing head can be made uniform regardless of the width of the printing tape. Consequently, high quality printing can be obtained regardless of the width of the printing tape. As a result, it is not necessary for the user to adjust or otherwise operate complicated tape cartridges in order to accommodate printing tapes having different widths. The adjustment of the printing apparatus is also unnecessary.

In the set of tape cartridges provided according to the third aspect of the present invention, the thicker the printing tape, the softer the rubber provided on the surface of the platen. Accordingly, the pressed state of the printing tape as it is pressed against the platen by the printing head can be made uniform regardless of the thickness of the printing tape. Consequently, high quality printing can be obtained regardless of the thickness of the printing tape. As a result, it is not necessary for the user to adjust or otherwise operate complicated tape cartridges in order to accommodate printing tapes having different thicknesses. The adjustment of the printing apparatus is also unnecessary.

In the set of tape cartridges provided according to the fourth aspect of the present invention, the harder, thicker or wider the printing tape, the smaller the outer diameter of the platen shaft and the thicker the platen rubber. Accordingly, the pressed state of the printing tape as it is pressed against the platen by the printing head can be made uniform regardless of the hardness, thickness or width of the printing tape. Consequently, high quality printing can be obtained regardless of the hardness, thickness or width of the printing tape. As a result, it is not necessary for the user adjust or otherwise operate complicated tape cartridges in order to accommodate printing tapes having different hardness, widths and thicknesses. The adjustment of the printing apparatus is also unnecessary.

In the set of tape cartridges provided according to the fifth aspect of the present invention, the contact surface of the platen rubber which makes contact with the printing tape has a roughness corresponding to both the roughness of the contacting surface of the printing tape and the material that the tape is fabricated from. Accordingly, a state in which the printing tape is conveyed can be made uniform regardless of the material and roughness of the contact surface of the printing tape. In addition, when the tape cartridge is left unused for a long time in a state where it has been mounted in the printing apparatus, printing tape discharge failure, which would occur due to adhesion of the printing tape with the platen, can be avoided.

In the tape cartridge provided according to the sixth aspect of the present invention, a hard platen is used which prevents the printing tape and ink ribbon from being firmly pressed against the substrate, even if a wide printing tape and ink ribbon are used. Smearing of the printing tape, which is caused when the printing tape and the ink ribbon are firmly pressed against the substrate of the printing head, can therefore be prevented.

In the tape cartridge provided according to the seventh aspect of the present invention, the employed ink ribbon is wider than the printing section of the printing head and narrower than the substrate of the printing head. Smearing of the printing tape, which is caused when the printing tape and the ink ribbon are firmly pressed against the substrate of the printing head, can therefore be prevented.

In the tape cartridge provided according to the eighth aspect of the present invention, the platen is wider than the printing section the printing head and narrower than the substrate of the printing head. Smearing of the printing tape, which is caused when the printing tape and the ink ribbon are firmly pressed against the substrate of the printing head, can therefore be prevented.

In the set of tape cartridges provided according to the ninth aspect of the present invention, the wider the ink ribbon, the softer the platen. Therefore, even if the pressing force of the printing head varies with the width of the ink ribbon, the hardness of the platen will correspond to the pressing force of the printing head. Accordingly, the positional relationship between the platen and the printing head remains the same, and consistent, high quality printing can be obtained.

In the tape cartridge provided according to aspects one through nine of the present invention, the platen has a barrel shape whose central portion has an outer diameter which is larger than an outer diameter of two end portions thereof. Thus, a situation in which the two side portions of the printing tape or ink ribbon are conveyed at a faster rate than the central portion thereof is avoided. Accordingly, shifting of the printing tape or ink ribbon to one end of the platen or twisting of the printing tape or ink ribbon can be eliminated. Furthermore, when compared with platens in which the outer diameter of the central portion is the same as the outer diameter of the two end portions, the barrel shaped platen is far less likely to be fabricated with an outer diameter which is smaller in the central portion of the platen and larger at the ends. This situation may occur as a result of inaccuracies in the fabrication process. The barrel shaped platen design greatly reduces the possibility that such faulty platens will result from the fabrication process. Accordingly, platens can be readily manufactured and yield can be increased.

The present invention provides in a tenth aspect thereof a kit of tape cartridges including at least two different types of tape cartridges. Each tape cartridge included in the kit is fitted with a platen which is specifically adapted to achieve ideal printing conditions when used with a particular combination of printing tape and ink ribbon. The printing tape accommodated by a particular cartridge in the kit has a particular hardness, thickness, width and color which distinguishes it from other tapes. The ink ribbon which is incorporated in a particular tape cartridge has a particular width and color which distinguishes it from other types of ink ribbons.

With the kit provided according to the tenth aspect of the present invention, a single printing apparatus may be used to perform printing operations on several different types of printing tapes. These printing operations can be performed without making any adjustment or modification to either the printing apparatus or the tape cartridges used in the printing operations. To perform printing on a different type of printing tape, the user simply removes the currently mounted tape cartridge using the appropriate dismounting procedure and mounts a new cartridge which employs the desired type of printing tape.

The present invention provides in an eleventh aspect thereof a method of manufacture of a kit including a set of tape cartridges. Each individual cartridge is fitted with a platen shaft with a platen rubber disposed thereon, with the platen being individually adapted so as to provide ideal printing conditions when used with a printing tape having a particular hardness, thickness and width.

Various other aspects and advantages of the present invention will become apparent to one skilled in the art after having the benefit of reading and studying the foregoing description and following claims.

What is claimed is:

1. A printing apparatus which has a printing head and a set of tape cartridges including at least two types of tape cartridges accommodating printing tapes having at least two different types of properties, and which can conduct printing on said printing tapes, a selected one of said tape cartridges being detachably mounted in said apparatus, each of said tape cartridges comprising:

a printing tape having a particular property selected from at least two different types of said properties; and a platen for nipping said printing tape in cooperation with said printing head in such a manner that printing can be conducted on said printing tape when said tape cartridge is mounted in said printing apparatus, said platen having a rubber disposed on a surface thereof, contact surfaces of said rubbers with said printing tapes in said platens having roughnesses corresponding to materials and roughnesses of contact surfaces of said printing tapes with said platens, the at least two types of cartridges having said contact surfaces of said rubbers that have roughnesses that are different from one another and said contact surfaces of said printing tapes that have roughnesses that are different from one another.

2. A printing apparatus which has a printing head and a set of tape cartridges including at least two types of tape cartridges accommodating printing tapes having at least two different types of hardness, and which can conduct printing on said printing tapes, a selected one of said tape cartridges being detachably mounted in said apparatus, each of said tape cartridges comprising:

a printing tape having a particular hardness property selected from at least two different types of said hardness; and a platen for nipping said printing tape in cooperation with said printing head in such a manner that printing can be conducted on said printing tape when said tape cartridge is mounted in said printing apparatus, with said platen having a rubber disposed on a surface thereof, the hardness of said platen rubber for a particular cartridge of the set being determined such that the platen rubber provided in the tape cartridge for accommodating the printing tape is softer than the platen rubber provided in a tape cartridge which accommodates a softer printing tape.

3. A printing apparatus which has a printing head and a set of tape cartridges including at least two types of tape cartridges accommodating printing tapes having at least two different types of widths, and which can conduct printing on said printing tapes, a selected one of said tape cartridges being detachably mounted in said apparatus, each of said tape cartridges comprising:

a printing tape having a particular width selected from at least two different types of said widths; and a platen for nipping said printing tape in cooperation with said printing head in such a manner that printing can be conducted on said printing tape when said tape cartridge is mounted in said printing apparatus, said platen having a rubber disposed on a surface thereof, the hardness of the rubbers of the platens being determined such that the rubber provided in a tape cartridge for accommodating a printing tape wider than the printing tape accommodated in other tape cartridges is softer than the rubbers provided in said other tape cartridges.

4. A printing apparatus which has a printing head and a set of tape cartridges including at least two types of tape cartridges accommodating printing tapes having at least two different types of thicknesses, and which can conduct printing on said printing tapes, a selected one of said tape cartridges being detachably mounted in said apparatus, each of said tape cartridges comprising:

a printing tape having a particular thickness selected from at least two different types of said thicknesses; and a platen for nipping said printing tape in cooperation with said printing head in such a manner that printing can be conducted on said printing tape when said tape cartridge is mounted in said printing apparatus, with said platen having a rubber disposed on a surface thereof, the hardness of the rubbers of the platens being determined such that the rubber provided in a tape cartridge for accommodating a printing tape thicker than the printing tape accommodated in other tape cartridges is softer than the rubbers provided in said other tape cartridges.

5. A printing apparatus which has a printing head and a set of tape cartridges including at least two types of tape cartridges accommodating printing tapes having at least two different combinations of hardness, thickness and width, and which can conduct printing on said printing tapes, a selected one of said tape cartridges being detachably mounted in said apparatus, each of said tape cartridges comprising:

a printing tape having a particular combination of hardness, thickness and width selected from at least two different of said combinations of hardness, thicknesses and width; and a platen for nipping said printing tape in cooperation with said printing head in such a manner that printing can be conducted on said printing tape when said tape cartridge is mounted in said printing apparatus, said platen including a shaft and a platen rubber fitted on said shaft;

the outer diameter of said shafts of said platens being determined such that the outer diameter of the shaft of the platen accommodated in a tape cartridge for accommodating a printing tape which is harder, thicker or wider than the printing tape accommodated in other tape cartridges is smaller than the outer diameter of the shafts provided in said other tape cartridges and that the thickness of the rubbers of the platens is determined such that the rubber provided in a tape cartridge for accommodating a printing tape which is harder, thicker or wider than the printing tapes accommodated in other tape cartridges is thicker than the rubbers provided in said other tape cartridges.

6. A printing apparatus which has a printing head and a set of tape cartridges including at least two types of tape cartridges accommodating ink ribbons having at least two different types of widths and printing tapes, and which can conduct printing on said printing tapes, a selected one of said tape cartridges being detachably mounted in said apparatus, each of said tape cartridges comprising:

a printing tape;

an ink ribbon to be used for printing conducted on said printing tape;

tension generation means for generating a tension in a longitudinal direction of said ink ribbon; and a platen for nipping said printing tape in cooperation with said printing head in such a manner that printing can be conducted on said printing tape when said tape cartridge is mounted in said printing apparatus, the tension of said tension generation means of said tape cartridges being determined in that the tension of the tension generation means provided in the tape cartridge accommodating an ink ribbon wider than ink ribbons in the other tape cartridges is larger than the tension for said other tape cartridges, said ink ribbon being accommodated in such a manner that the tension generated by said tension generation means moves said printing head away from said platen, and that an outer diameter of said platens is determined such that the outer diameter of the platen in a tape cartridge accommodating an ink ribbon wider than ink ribbons accommodated in the other tape cartridges is smaller than the outer diameter of the platens of said other tape cartridges.

7. The printing apparatus according to claim 6, wherein a hardness of said platen of each said tape cartridge is determined such that the platen in a tape cartridge accommodating an ink ribbon which is wider than ink ribbons accommodating an ink ribbon which is wider than ink ribbons accommodated in other tape cartridges is softer than the platens in said other tape cartridges.

8. The printing apparatus according to claim 7, wherein said platen of each said tape cartridge has a barrel shape whose central portion has an outer diameter larger than an outer diameter of two end portions thereof.

* * * * *